US008070013B2

(12) United States Patent
Reinsel et al.

(10) Patent No.: US 8,070,013 B2
(45) Date of Patent: Dec. 6, 2011

(54) CUTLERY UTENSIL DISPENSING APPARATUS AND METHOD

(75) Inventors: Christopher M. Reinsel, Neenah, WI (US); Patrick J. Smith, Iola, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 466 days.

(21) Appl. No.: 12/349,203

(22) Filed: Jan. 6, 2009

(65) Prior Publication Data

US 2010/0170915 A1 Jul. 8, 2010

(51) Int. Cl.
*A47F 1/10* (2006.01)

(52) U.S. Cl. ..... 221/255; 221/261; 221/87; 221/191

(58) Field of Classification Search ..... 221/87, 221/89, 191, 224, 226, 232, 240, 255, 261, 221/311
See application file for complete search history.

(56) References Cited

U.S. PATENT DOCUMENTS

| | | | |
|---|---|---|---|
| 592,105 | A | 10/1897 | Barnes |
| 925,485 | A | 6/1909 | Lafler |
| 999,837 | A | 8/1911 | Morris et al. |
| 1,146,447 | A | 7/1915 | Prommel |
| 1,259,927 | A | 3/1918 | Swift |
| 1,355,583 | A | 10/1920 | Zeidler et al. |
| 1,482,071 | A | 1/1924 | Duff et al. |
| 1,504,098 | A | 8/1924 | Cathey |
| 1,546,077 | A | 7/1925 | Hunter et al. |
| 1,547,151 | A | 7/1925 | Watling |
| 1,577,302 | A | 3/1926 | Schultz |
| 1,610,001 | A | 12/1926 | Foster |
| 1,675,510 | A | 7/1928 | Nolan |
| 1,886,378 | A | 11/1932 | Dearsley |
| 2,053,828 | A | 9/1936 | Harper |
| 2,078,984 | A | 5/1937 | Williamson |
| 2,110,189 | A | 3/1938 | Zeidler, Sr. |
| 2,141,684 | A | 12/1938 | Diemer |
| 2,149,098 | A | 2/1939 | Phinney |
| 2,149,099 | A | 2/1939 | Phinney et al. |

(Continued)

FOREIGN PATENT DOCUMENTS

CA 2545745 A1 11/2006

(Continued)

OTHER PUBLICATIONS

PCT International Search Report for International Application No. PCT/US2007/083752; International Filing Date: Nov. 6, 2007; Date of Mailing: Mar. 11, 2008; 6 pgs.

(Continued)

*Primary Examiner* — Patrick MacKey
(74) *Attorney, Agent, or Firm* — William W. Letson

(57) ABSTRACT

A cutlery utensil dispenser has a dispensing tray with a floor and a region housing a cutlery utensil. The cutlery utensil has first and second portions and is moved by an engagement portion of an actuator from a first orientation to a second orientation. In the first orientation, the cutlery utensil rests on the floor in the region and is within the cutlery utensil dispenser, inaccessible to a user. In the second orientation, the second portion of the cutlery utensil projects from the cutlery utensil dispenser and is accessible to the user. A wall of the region has a fulcrum end dimensioned to engage the cutlery utensil. The cutlery utensil rotates about the fulcrum end responsive to the engagement portion toward an exit of the dispenser.

33 Claims, 19 Drawing Sheets

U.S. PATENT DOCUMENTS 2,188,573 A 1/1940 Longo
2,207,528 A 7/1940 Witt
2,239,196 A 4/1941 Lunvik
2,260,596 A 10/1941 Young
2,268,596 A 1/1942 Jerum
2,268,873 A * 1/1942 Hopkins et al. ..... 221/242
2,340,561 A 2/1944 Renfro
2,421,782 A 6/1947 Gibbs et al.
2,472,051 A * 5/1949 Testi ..... 221/232
2,571,668 A 10/1951 Booth et al.
2,577,344 A 12/1951 Masure
2,635,025 A 4/1953 Ziska
2,646,874 A 7/1953 Testi
2,671,555 A 3/1954 Shnitzler
2,692,691 A 10/1954 Harriss et al.
2,752,678 A 7/1956 Welch
2,868,344 A 1/1959 Shields
2,877,926 A 3/1959 Abbe
2,880,907 A 4/1959 Mainers
2,889,076 A 6/1959 Van Schie
2,911,127 A * 11/1959 Driss et al. ..... 221/258
2,924,357 A 2/1960 Kingsley et al.
2,946,431 A 7/1960 Nissen
2,954,948 A 10/1960 Johnson
2,965,262 A 12/1960 Du Bois
3,083,879 A 4/1963 Coleman
3,095,114 A 6/1963 Tobias
3,100,842 A 8/1963 Tellefsen
3,114,475 A 12/1963 Etes
3,132,765 A 5/1964 Florendo
3,163,327 A 12/1964 Maxwell
3,263,860 A 8/1966 Haas
3,300,087 A 1/1967 Kuypers
3,313,452 A 4/1967 Katz
3,334,784 A 8/1967 Morrison
3,371,821 A * 3/1968 Abood, Jr. et al. ..... 221/93
3,407,927 A 10/1968 Jones
3,426,941 A 2/1969 Hovekamp
3,472,421 A 10/1969 Baller
3,499,538 A 3/1970 Sherard
3,558,006 A 1/1971 Redmond et al.
3,587,922 A 6/1971 Oriti
3,680,736 A 8/1972 Viessmann
3,786,959 A * 1/1974 Greb et al. ..... 221/261
4,134,519 A 1/1979 Barnett et al.
4,308,974 A 1/1982 Jones
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
4,610,087 A 9/1986 Mickelson et al.
4,614,004 A 9/1986 Oshida
4,662,536 A 5/1987 Powers
4,691,811 A 9/1987 Arakawa et al.
4,697,673 A 10/1987 Omata
4,715,514 A 12/1987 Vidondo
4,789,064 A 12/1988 Segal
4,896,792 A 1/1990 Marchand
4,973,037 A 11/1990 Holbrook
4,986,442 A 1/1991 Hinterreiter
5,127,546 A 7/1992 Chen
5,131,586 A 7/1992 Capy
5,191,997 A 3/1993 Squitieri
5,211,267 A 5/1993 Clark
5,249,705 A 10/1993 Gates
D342,648 S 12/1993 Cautereels et al.
5,269,397 A 12/1993 Kawamoto et al.
5,364,016 A 11/1994 Capy et al.
5,413,317 A 5/1995 Spoerre
5,449,054 A 9/1995 Wiese et al.
5,460,252 A 10/1995 Kosugi et al.
5,469,688 A 11/1995 Dunbar et al.
5,497,863 A 3/1996 Schmidt et al.
5,509,522 A 4/1996 Laidlaw
5,542,508 A 8/1996 Van Erden et al.
5,564,594 A * 10/1996 Monfredo ..... 221/150 A
5,586,685 A 12/1996 Dorner et al.
5,605,208 A 2/1997 Friedrichsen et al.
5,660,252 A 8/1997 Lafon
5,904,250 A 5/1999 De Schutter
5,921,408 A 7/1999 Groenewold et al.
6,023,913 A 2/2000 Gray et al.
6,047,830 A 4/2000 Chang
6,202,891 B1 3/2001 Mark
6,250,498 B1 6/2001 Lovejoy
6,298,960 B1 10/2001 Derr
6,336,568 B1 1/2002 Tucker et al.
6,626,633 B2 9/2003 Jendzurski et al.
6,651,841 B2 11/2003 Tsuchida
D492,549 S 7/2004 Welch
D493,337 S 7/2004 Welch
6,763,972 B2 7/2004 Graupner
6,832,694 B2 12/2004 Goeking et al.
6,837,028 B1 * 1/2005 Miano et al. ..... 53/443
6,840,353 B2 1/2005 Arisaka
6,945,427 B2 9/2005 Hieb
6,972,033 B2 12/2005 McNicholas
6,976,348 B1 12/2005 Miano et al.
7,076,932 B2 7/2006 Rubin
7,210,279 B1 5/2007 Ahmed et al.
7,322,172 B2 1/2008 Hoffman et al.
7,412,808 B2 8/2008 Lavi
D591,104 S 4/2009 Oakes
7,513,089 B2 4/2009 Rubin
7,520,247 B2 4/2009 Rutledge
2002/0112445 A1 8/2002 Scaduto
2003/0015824 A1 1/2003 Forbes et al.
2003/0146061 A1 8/2003 Tournier
2004/0045398 A1 3/2004 Hayashi
2004/0045860 A1 3/2004 Edgerly et al.
2004/0089670 A1 5/2004 Goeking et al.
2005/0082307 A1 4/2005 Tucker
2005/0155229 A1 7/2005 Lee
2005/0252057 A1 11/2005 Lavi
2006/0000190 A1 1/2006 Behnke et al.
2007/0108141 A1 5/2007 Smith et al.
2007/0131705 A1 6/2007 Behravesh et al.
2007/0193968 A1 8/2007 Smith et al.
2008/0121650 A1 5/2008 Smith
2010/0084418 A1 4/2010 Reinsel et al.
2010/0147869 A1 6/2010 Iliffe et al.

FOREIGN PATENT DOCUMENTS

CN 2865478 Y 2/2007
DE 7033238 U 11/1970
DE 7127677 U 7/1971
DE 3151268 7/1983
DE 4139938 A1 6/1993
DE 9316566 U1 1/1994
DE 19906369 C1 2/2000
DE 202005013647 U1 7/2006
EP 0856272 A2 8/1998
EP 0856272 A3 1/1999
EP 1022107 A1 7/2000
EP 1217923 B1 9/2003
EP 1213985 B1 6/2004
EP 1514497 A1 3/2005
EP 1719438 A1 11/2006
EP 1864596 A2 12/2007
WO 0105280 A1 1/2001
WO 0105281 A1 1/2001
WO 0168492 A1 9/2001
WO 2004028309 A1 4/2004
WO 2007049982 A1 5/2007
WO 2007124606 A1 11/2007
WO 2008058187 A3 5/2008

OTHER PUBLICATIONS

PCT International Search Report and Written Opinion for International Application No. PCT/US2007/083922; International Filing Date: Nov. 7, 2007; Date of Mailing: Nov. 17, 2008; 14 pgs.
English Abstract for DE3151268; 1 pg., Jul. 7, 1983.
English Abstract for DE4139938; 1 pg., Jun. 9, 1993.
English Abstract for DE19906369; 1 pg., Feb. 24, 2000.

Peel Adhesion for Single Coated Pressure-Sensitive Tapes 180 Angle, Aug. 1989, pp. 21-22.
Tack Rolling Ball, Aug. 1989, pp. 29-30.
Holding Power of Pressure-Sensitive Tape, Aug. 1989, pp. 31-33.
European Search Report for 06009258.2, mailed Jul. 24, 2006, five pages, Munich, Germany.
Written Opinion for PCT/US07/83752, mailed Mar. 11, 2008, six pages, European Patent Office, Munich, Germany.
Partial International Search Report for PCT/US2007/083922, mailed Jul. 8, 2008, two pages.
European Search Report for EP 08 014 387.8, mailed Nov. 11, 2008, four pages, European Patent Office, Munich, Germany.
International Search Report and Written Opinion for PCT/US2009/059915, mailed Feb. 3, 2010, 13 pages, European Patent Office, Munich, Germany.
Office Action for U.S. Appl. No. 11/415,836, filed May 2, 2006.
Office Actions for U.S. Appl. No. 11/556,808, filed Nov. 6, 2006.
Office Actions for U.S. Appl. No. 11/936,401, filed Nov. 7, 2007.

* cited by examiner

CUTLERY UTENSIL DISPENSING APPARATUS AND METHOD

BACKGROUND

The present disclosure relates generally to a method of dispensing cutlery utensils, such as with a cutlery utensil dispenser, from, for example, single and multiple stacks of cutlery utensils.

Eating facilities often provide cutlery utensils in dispensing bins, where all customers place their hands into the bins in order to retrieve a knife, fork, spoon or spork. While such arrangements provide for economical dispensing of cutlery utensils, as opposed to sets of utensils being separately wrapped in plastic sleeves, the open air bins are not very hygienic, and can spread hand-carried bacteria and the like to other utensils in the bin or potentially to another customer.

In an attempt to address concerns relating to the hygienic dispensing of cutlery utensils, enclosed dispensers have been employed where a stack of cutlery utensils is placed in a utensil compartment and the cutlery utensils are dispensed one at a time on command by operation of a dispensing lever. Such arrangements may be suitable for their intended purpose, but are also limited by the capacity of utensils they are capable of holding. One remedy to such a capacity issue may be to simply make the utensil compartment taller, thereby enabling multiple stacks of pre-measured and pre-assembled cutlery utensils to be placed one on top of the other. However, such a dispenser would be quite tall, would require refilling from a relatively high level, and would require each of the separate stacks to be properly aligned one on top of the other during refilling so that the cutlery utensils are properly aligned for dispensing. Additionally, the cutlery utensils being dispensed must be made accessible to the user, preferably by making only the handling portion of the cutlery utensil accessible to enhance hygiene of the utility end of the cutlery utensil. In view of these and other issues, there is a need in the art for an improved cutlery utensil dispensing method and dispenser for implementing such a method.

BRIEF DESCRIPTION

An embodiment of a cutlery utensil dispenser for dispensing cutlery utensils has a dispensing tray including a floor and a region dimensioned and configured to house a cutlery utensil. The cutlery utensil has first and second portions and is housed in a first orientation in which the cutlery utensil rests on the floor in the region and in which the cutlery utensil is within the cutlery utensil dispenser and inaccessible to a user. A wall of the region has a fulcrum end dimensioned to engage the cutlery utensil. A dispensing mechanism including an engagement portion selectively engages the cutlery utensil moves an engaged portion of the cutlery utensil toward an exit of the dispenser such that the cutlery utensil rotates about the fulcrum end until the second portion of the cutlery utensil projects from the cutlery utensil dispenser and is accessible to the user in a second orientation.

Another embodiment of a cutlery utensil dispenser includes a housing with an exit, a base supporting the housing, and a first utensil compartment within the housing. The first utensil compartment includes a floor and a wall and is dimensioned to house a cutlery utensil in a first orientation in which a handling portion of the cutlery utensil is substantially parallel to the floor along a longitudinal axis of the cutlery utensil, and in which the cutlery utensil is inaccessible to a user within the first utensil compartment. A dispensing mechanism includes a first engagement portion extending into the first utensil compartment. A fulcrum formed in the compartment establishes, at a distance $y_1$ from an exterior of the exit, a pivot axis substantially transverse to a floor of the compartment and about which the cutlery utensil can rotate. The cutlery utensil rotates with the handling portion remaining substantially parallel to the floor, responsive to movement of the cutlery utensil induced by movement of the engagement portion, from the first orientation to a second orientation in which a utility portion of the cutlery utensil remains in the housing inaccessible to the user while the handling portion of the cutlery utensil is accessible to the user.

Another embodiment of a cutlery utensil dispenser comprises a housing and a compartment having a floor and a wall disposed within the housing and having a shape that receives a cutlery utensil in a first orientation in which the cutlery utensil is inaccessible to an end user and in which a substantially planar handling portion of the cutlery utensil is substantially parallel to the floor. The housing has an exit sized to accommodate the handling portion of the cutlery utensil. A dispensing mechanism disposed within the housing is in mechanical interaction with the cutlery utensil, and the housing has a pivot point engageable with a dispensed cutlery utensil and about which the dispensed cutlery utensil, responsive to the dispensing mechanism, rotates with the handling portion remaining substantially parallel to the floor. The dispensed cutlery utensil rotates from the first orientation into a second orientation in which the handling portion protrudes from the exit in the housing and is accessible to the end user while a utility portion of the cutlery utensil remains within the housing and inaccessible to the end user.

DETAILED DESCRIPTION

Figure 1:
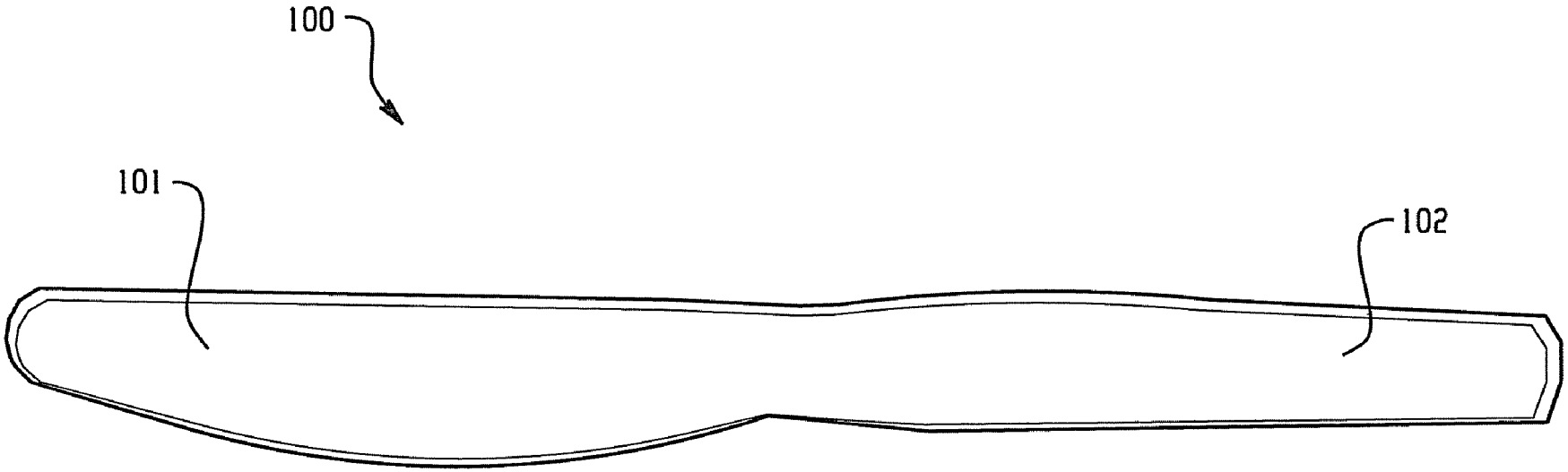
FIG. 1 is an elevational view of a cutlery utensil used in an embodiment.

With reference to the accompanying Figures, examples of a cutlery utensil dispensing method and apparatus according to embodiments of the invention are disclosed. For purposes of explanation, numerous specific details are shown in the drawings and set forth in the detailed description that follows in order to provide a thorough understanding of embodiments of the invention. It will be apparent, however, that embodiments of the invention may be practiced without these specific details. In other instances, well-known structures and devices are schematically shown in order to simplify the drawing.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one ore more other features, integers, steps, operations, element components, and/or groups thereof.

The corresponding structures, materials, acts, and equivalents of any and all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

With reference to the accompanying FIGS., embodiments comprise a method of dispensing a cutlery utensil, such as, but not limited to, a knife, a fork, a spoon, or a spork. An example of a cutlery utensil, in this case a knife, is shown in FIG. 1, in which the cutlery utensil 100 includes first and second portions 101, 102. The first portion 101 in embodiments is a utility portion, such as, but not limited to, the tines of a fork or spork, the bowl of a spoon or spork, or the blade of a knife. The second portion 102 in embodiments is a handling portion, such as a handle of a cutlery utensil. It should be understood that while the drawings show one type of cutlery utensil, embodiments are useful with other types of cutlery utensils.

Figure 2:
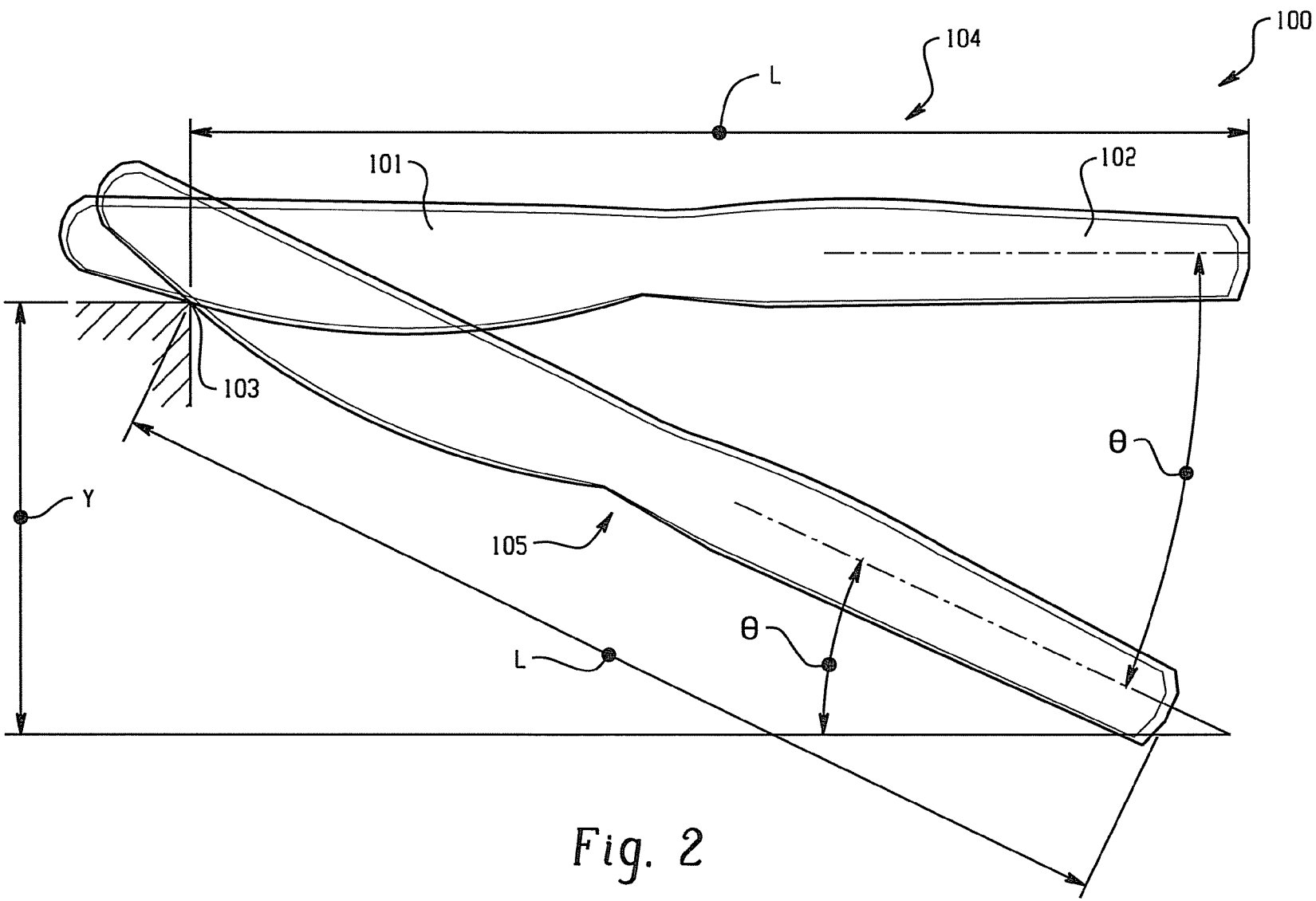
FIG. 2 is a schematic elevational view of a cutlery utensil being rotated about a pivot point from a first orientation into a second orientation according to an embodiment.

The method in an embodiment comprises rotating a cutlery utensil 100 about a pivot point 103 from a first orientation 104 to a second orientation 105 as seen, for example, in FIG. 2.

Figure 3:
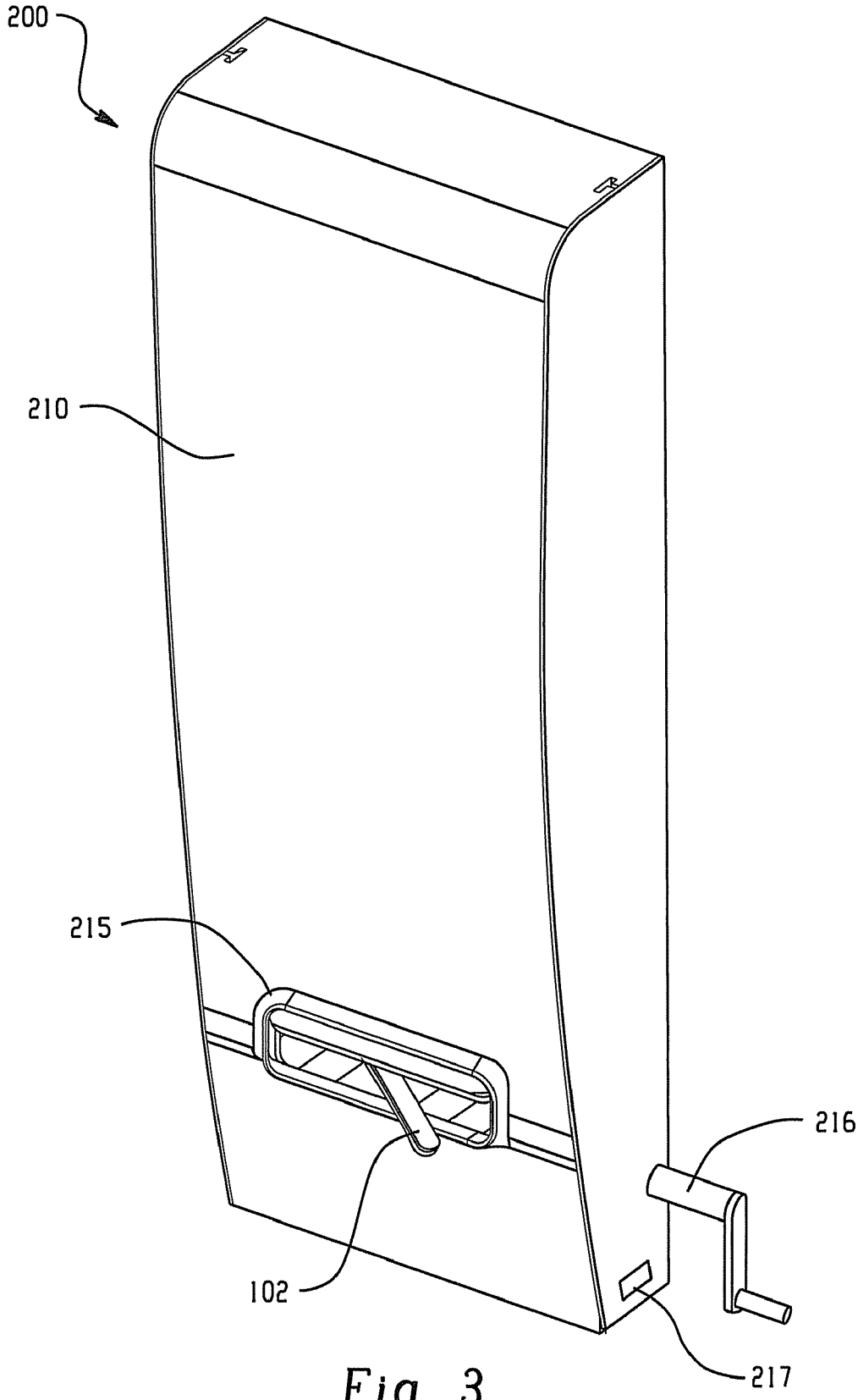
FIG. 3 is a schematic isometric view of a dispenser implementing an embodiment.

As seen in FIG. 3, an example embodiment is implemented with a dispenser 200 including a housing 210 and an exit 215. While the exit 215 is shown as part of the dispenser 200, the exit 215 can be included in other parts of the dispenser 200 in embodiments. The dispenser 200 includes a manual trigger 216, such as a handle, or an electric trigger 217, such as a sensor or a switch, with which a user can command the dispenser 200 to dispense a cutlery utensil 100 so that the second portion 102 projects from the exit 215. The user can then grasp the second portion 102, which in embodiments is the handling portion, and remove the cutlery utensil 100 from the dispenser 200. While the manual and electric triggers are shown on the side of the dispenser, it is within the scope of embodiments to place the manual and/or electric triggers in other locations on the dispenser.

Figure 4:
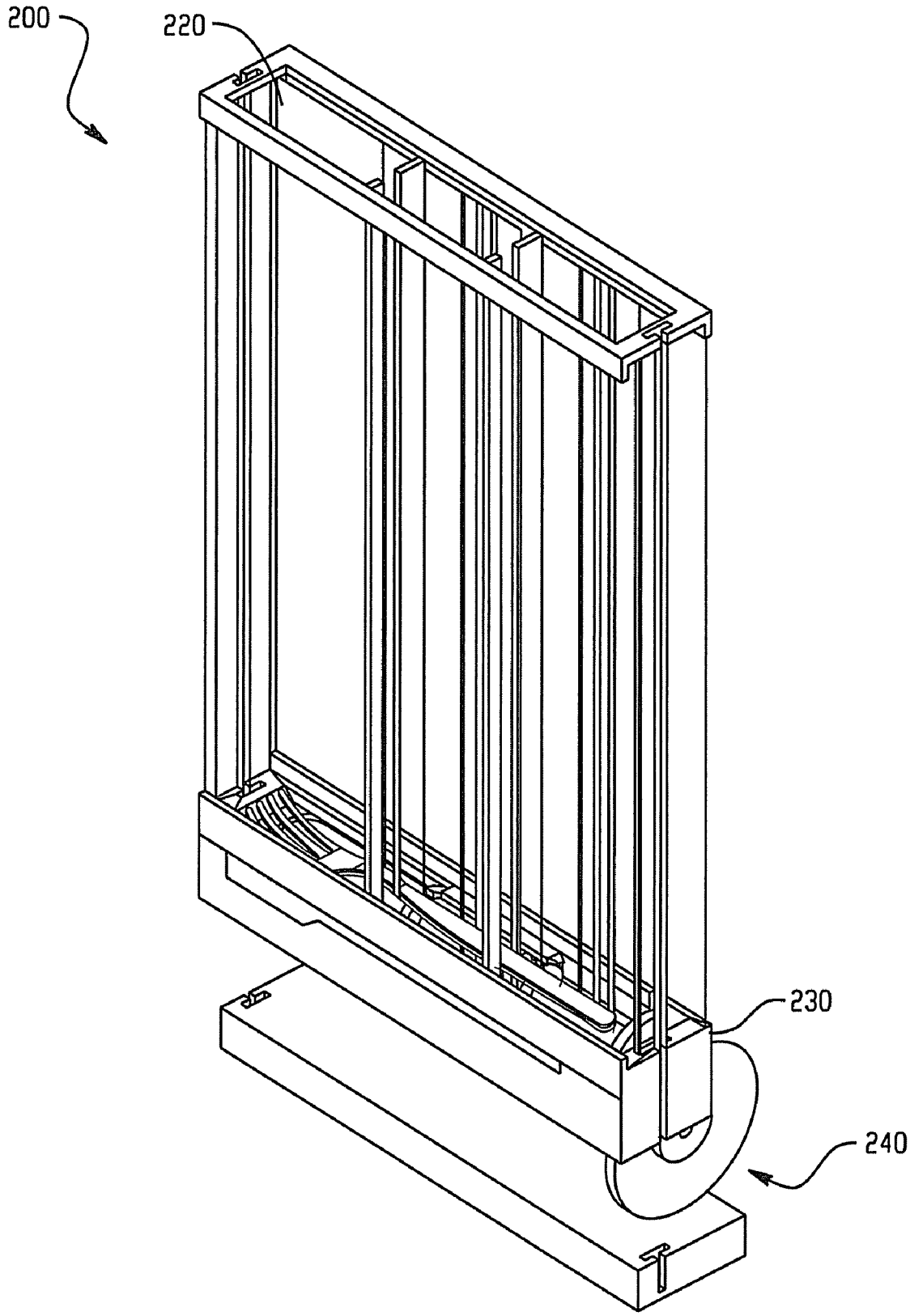
FIG. 4 is a schematic isometric view of a dispenser implementing an embodiment with its housing removed.

As seen in FIG. 4, which shows the interior of the dispenser 200 with the housing 210 removed, the dispenser 200 includes a compartment 220 dimensioned to receive a stack of substantially identical cutlery utensils 100. The bottom of the stack rests on a dispensing tray 230, and a dispensing mechanism 240 responsive to the manual trigger 216 or the electric trigger 217 to rotate the bottom cutlery utensil 100 from the first orientation 104 into the second orientation 105. In FIG. 4, the bottom cutlery utensil 100 is a fork and is in the first orientation 104, in which the cutlery utensil 100 is inaccessible to the user since the entire cutlery utensil 100 is retained within the dispenser 200.

Figure 5:
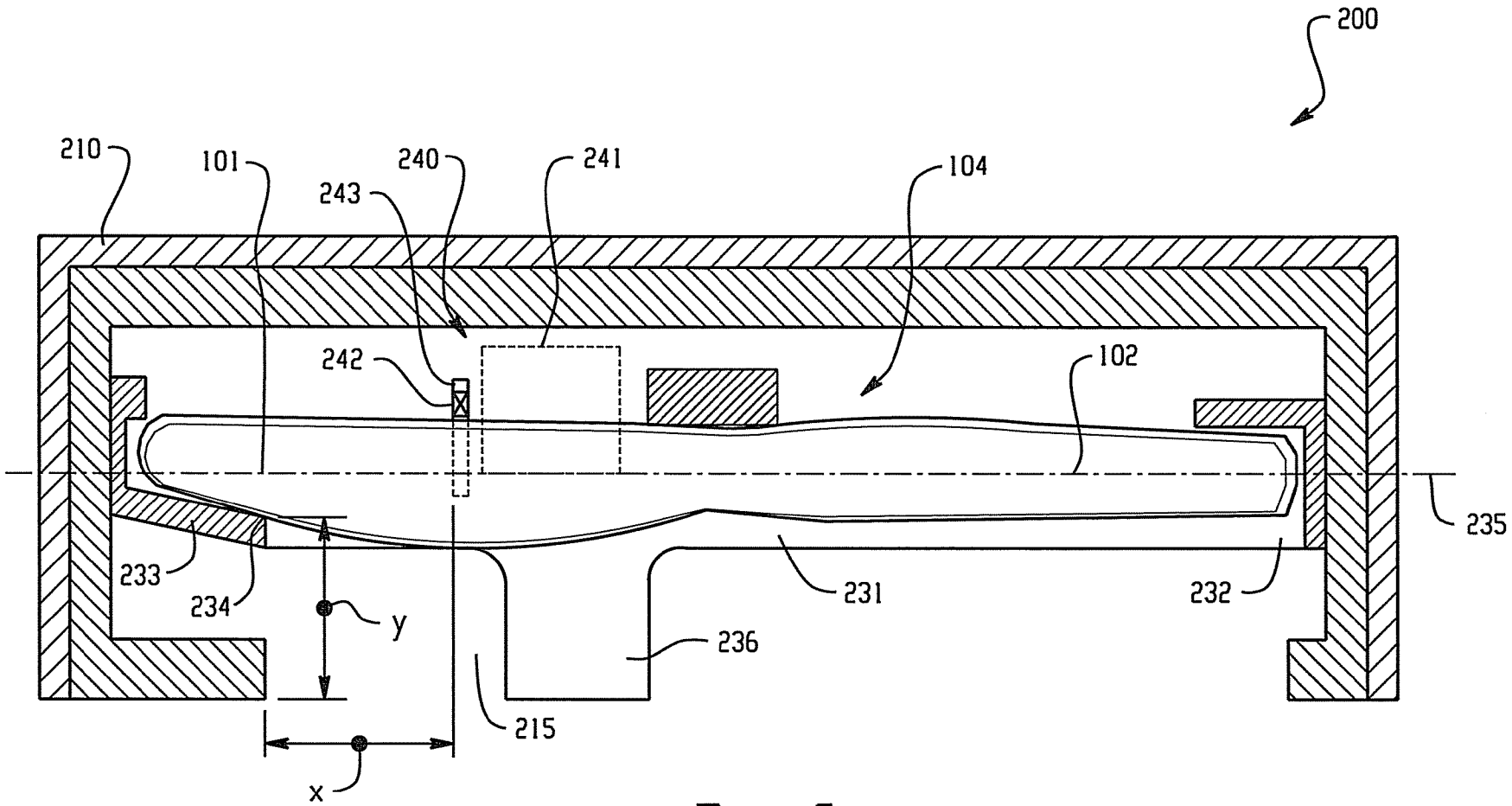
FIG. 5 is a top cross sectional view of a cutlery utensil dispenser implementing an embodiment with a cutlery utensil in a first orientation.

As seen in FIG. 5, the dispensing tray 230 includes a floor 231 with a region 232 dimensioned to retain the bottom cutlery utensil 100 of the stack of cutlery utensils retained in the compartment 220. The cutlery utensil 100 rests on the floor 231 in the region 232 and is retained in part by a wall 233 of the region 232, such as a partial wall. The pivot point 103 in an embodiment is a fulcrum end 234 of the wall 233 of the region 232, but can be a pin or other suitable formation or element. In the first orientation 104, a longitudinal axis of the second portion 102 of the cutlery utensil 100, represented by the dashed line in FIG. 2, is at an angle relative to the floor 231. For example, in an embodiment the second portion 102 rests with its longitudinal axis at an angle of substantially zero degrees relative to the floor 231 so that the longitudinal axis is substantially parallel to the floor 231 in the first orientation 104. To rotate the cutlery utensil 100, a dispensing mechanism 240 is provided that includes an actuator 241 mounted, for example, beneath the floor of the compartment, as represented by the dashed lines in FIGS. 5 and 6. The dispensing mechanism 240, responsive to a trigger 216, 217 as discussed above, uses the actuator 241 to move an engagement portion 242 into engagement with the cutlery utensil 100. In the embodiment shown as an example, the engagement portion 242 is moved along a slot 243. In an embodiment, the slot 243 extends at least a distance d transverse to a longitudinal axis 235 of the region 232. While the engagement portion 242 is shown as engaging the first portion 101 of the cutlery utensil 100, it should be apparent that embodiments can instead have the engagement portion 242 engaging the second portion 102. However, as will be explained below, having the engagement portion 242 engage the cutlery utensil 100 closer to the fulcrum end 234 requires a smaller distance d.

Figure 6:
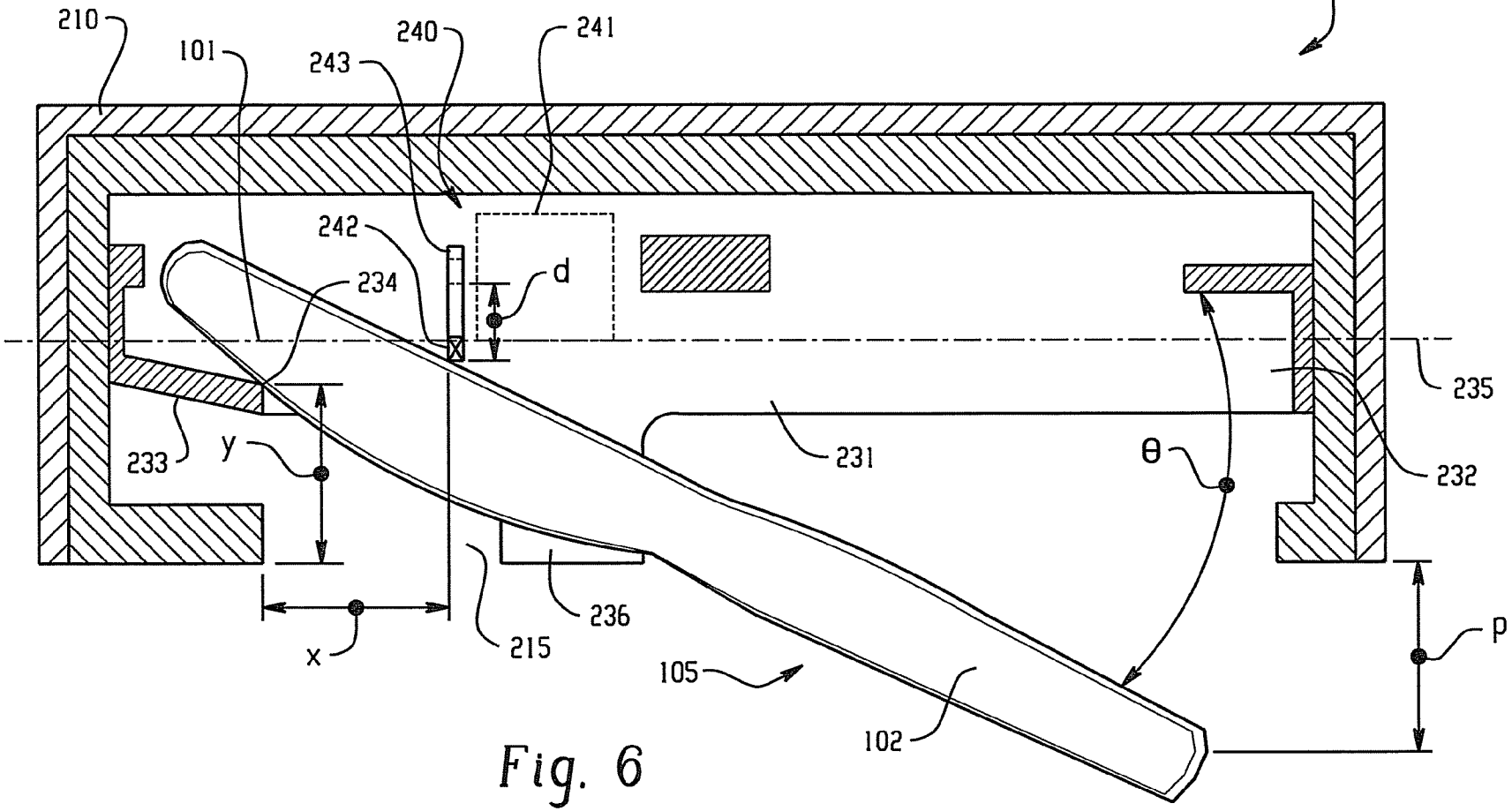
FIG. 6 is a top cross sectional view of a cutlery utensil dispenser implementing an embodiment with a cutlery utensil in a second orientation.
Figure 7:
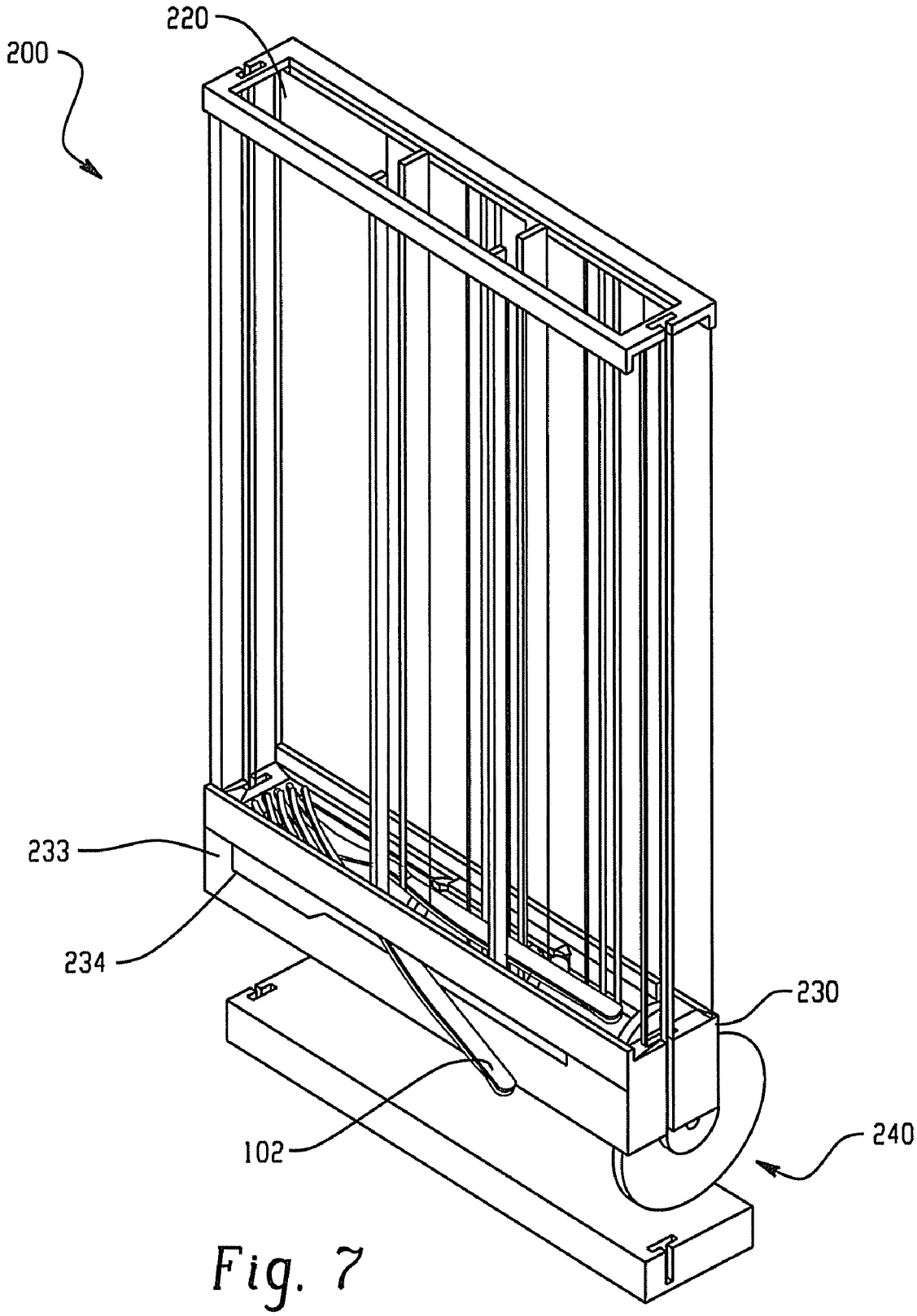
FIG. 7 is a schematic isometric view of a dispenser implementing an embodiment with its housing removed and a cutlery utensil in the second orientation.

As the engagement portion 242 slides the portion of the cutlery utensil 100 it engages, the cutlery utensil 100 begins to rotate about the fulcrum end 234 of the wall 233 out of the first orientation 104 shown in FIG. 5. In an embodiment, the engagement portion 242 remains flush with or beneath the floor 231 until it is moved. The dispensing mechanism 240 moves the engagement portion 242 so that, as seen in FIG. 6, the cutlery utensil 100 rotates to the second orientation 105 with the second portion 102 of the cutlery utensil 100 remaining at the same angle relative to the floor 231. In the example embodiment in which the second portion 102 is substantially parallel to the floor 231 in the first orientation 104, the second portion 102 remains substantially parallel to the floor 231 during rotation and in the second orientation 105. A substantially flat second portion is also substantially parallel to the floor in a direction transverse to the longitudinal axis of the second portion in the first orientation of an embodiment. In an embodiment, a support tongue 236 supports the cutlery utensil 100 in the second orientation 105. As seen in FIG. 7, the second portion 102 of the cutlery utensil 100 projects from the dispensing tray 230, and from the exit 215 of the dispenser 200, from which the user can grasp the second portion 102 and remove the cutlery utensil 100 from the dispenser 200.

In the course of rotation, as seen in FIGS. 2, 5, and 6, the cutlery utensil 100 sweeps through an angle θ that varies with a distance x of the engagement portion 242 from the pivot point 103, such as the fulcrum end 234 of the wall 233, as well as a distance y of the pivot point 103 from the exit 215 of the dispenser 200. However, it is more practical to refer to the distance Y representing the distance y to the exit 215 plus the distance p by which the utensil extends from the housing 210. More specifically, the angle θ is larger for smaller distances x and must be larger for larger distances Y to enable the second portion 102 of the cutlery utensil 100 to project through the exit 215 by the same amount p for a given length L from the pivot point 103 to the end of the second portion 102 of the cutlery utensil 100. The angle θ is related to the distances and length by the formula $$\theta \approx \sin^{-1}(Y/L) \approx \tan^{-1}(d/x),$$

Thus, for a given length L, distance Y, and displacement d of the engagement portion 242, the approximate required position of the engagement portion can be found using:

$$x \approx (d/\tan(\sin^{-1}(Y/L)))$$

Figure 8:
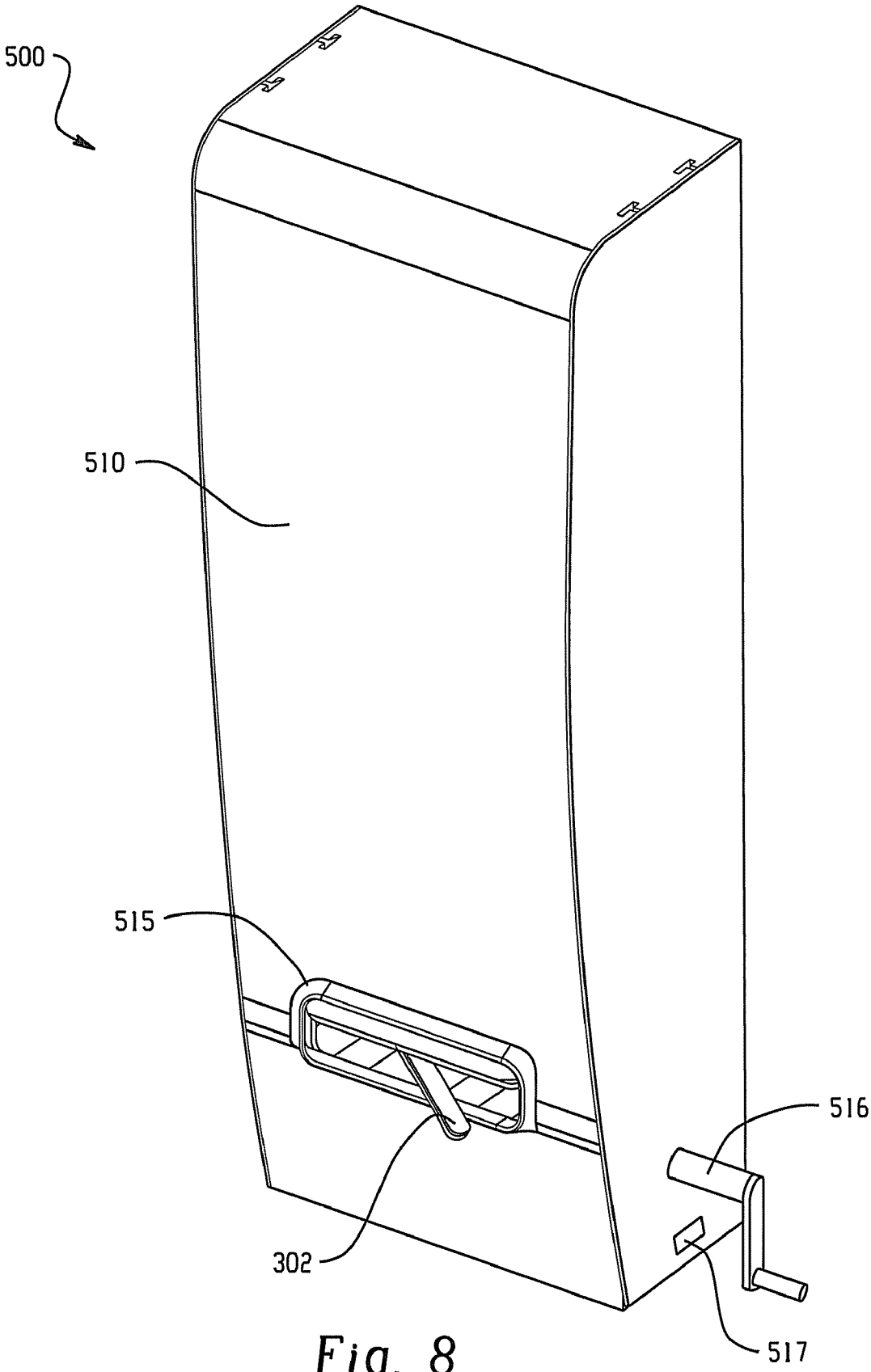
FIG. 8 is a schematic isometric view of a dispenser implementing an embodiment with multiple stacks of cutlery utensils with a cutlery utensil in the second orientation.
Figure 9:
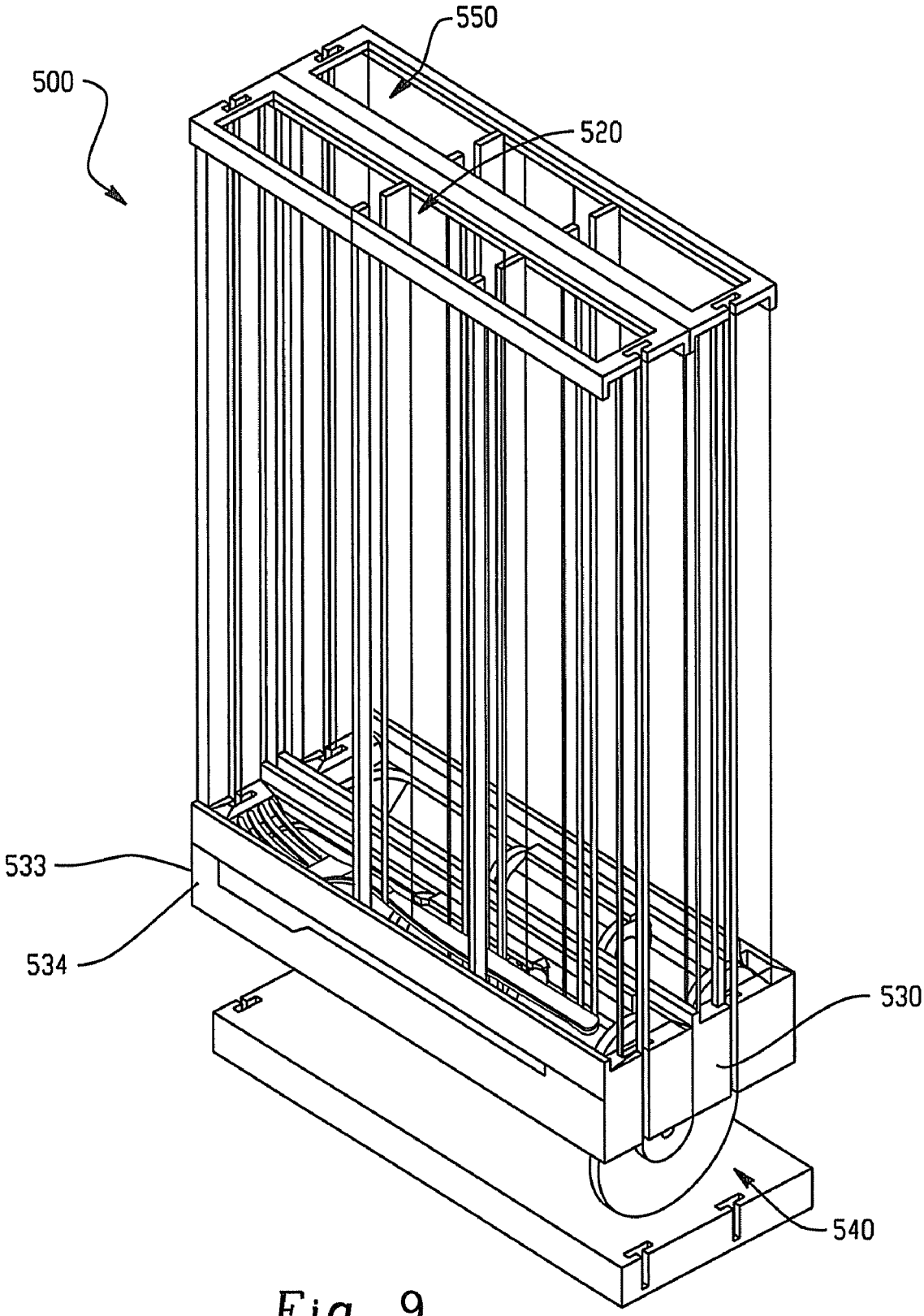
FIG. 9 is a schematic isometric view of a dispenser implementing an embodiment with multiple stacks of cutlery utensils with its housing removed and a cutlery utensil in the first orientation.

An external view of a dispenser 500 of an embodiment in which multiple stacks of cutlery utensils are housed is shown in FIG. 8. As with the embodiment of FIG. 3, the dispenser 500 includes a housing 510 and an exit 515. While the exit 515 is shown as part of the housing 510, the exit 515 can be included in other parts of the dispenser 500 in embodiments. The dispenser 500 includes a manual trigger 516, such as a handle, and/or an electric trigger 517, such as a sensor, a button, or a switch, with which a user can command the dispenser 500 to dispense, for example, a first cutlery utensil 300 so that the second portion 302 projects from the exit 515. The user can then grasp the second portion 302, which in embodiments is the handling portion, and remove the cutlery utensil 300 from the dispenser 500. FIG. 9 shows the dispenser 500 with the housing 210 removed, revealing two compartments 520, 550 dimensioned to receive and retain respective stacks of cutlery utensils. Other views of this example embodiment are seen in FIGS. 10-18 and are described below.

Figure 10:
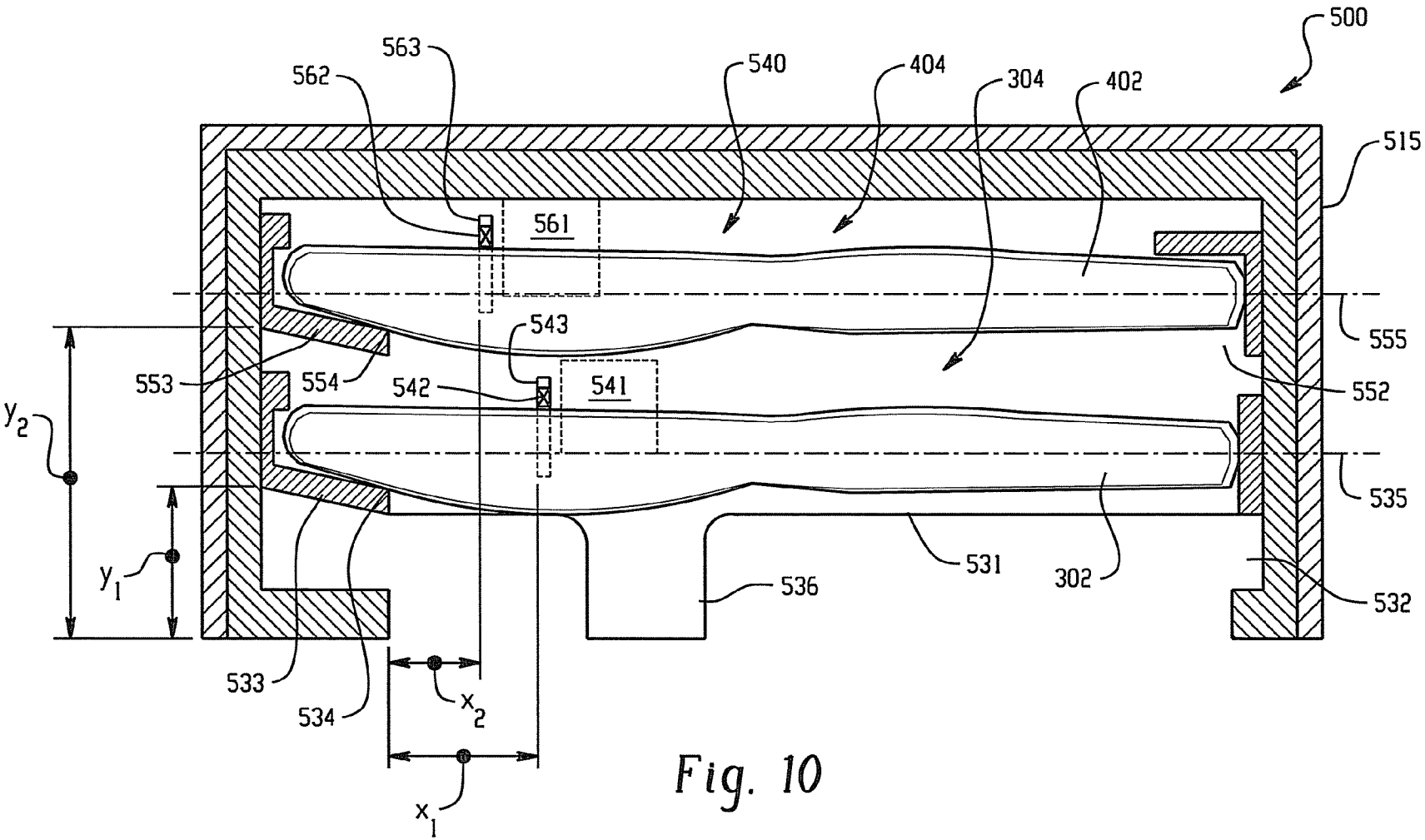
FIG. 10 is a schematic top cross sectional view of a multiple compartment cutlery utensil dispenser implementing an embodiment with all cutlery utensils in the first orientation.

As seen in variously in FIGS. 9-15, with particular reference to FIGS. 9 and 10, the dispensing tray 530 includes a floor 531 with a region 532 dimensioned to retain the first cutlery utensil 300. The first cutlery utensil 300 in an embodiment is the bottom cutlery utensil of a first stack of cutlery utensils retained in the first compartment 520. The first cutlery utensil 300, having first and second portions 301, 302, rests on the floor 531 as in the embodiment of FIG. 3, and is retained in part by a first wall 533 of the first region 532, such as a partial wall. The first pivot point 303 in an embodiment is a fulcrum end 534 of the first wall 533 of the first region 532, but can be a pin or other suitable formation or element. In the first orientation 304, a longitudinal axis of the second portion 302 of the cutlery utensil 300 is at an angle relative to the floor 531. The longitudinal axis is the same in this example as in the cutlery utensil 100 of FIG. 2. For example, in an embodiment the second portion 102 rests with its longitudinal axis at an angle of substantially zero degrees relative to the floor 531 so that the longitudinal axis is substantially parallel to the floor 531 in the first orientation 304.

Figure 11:
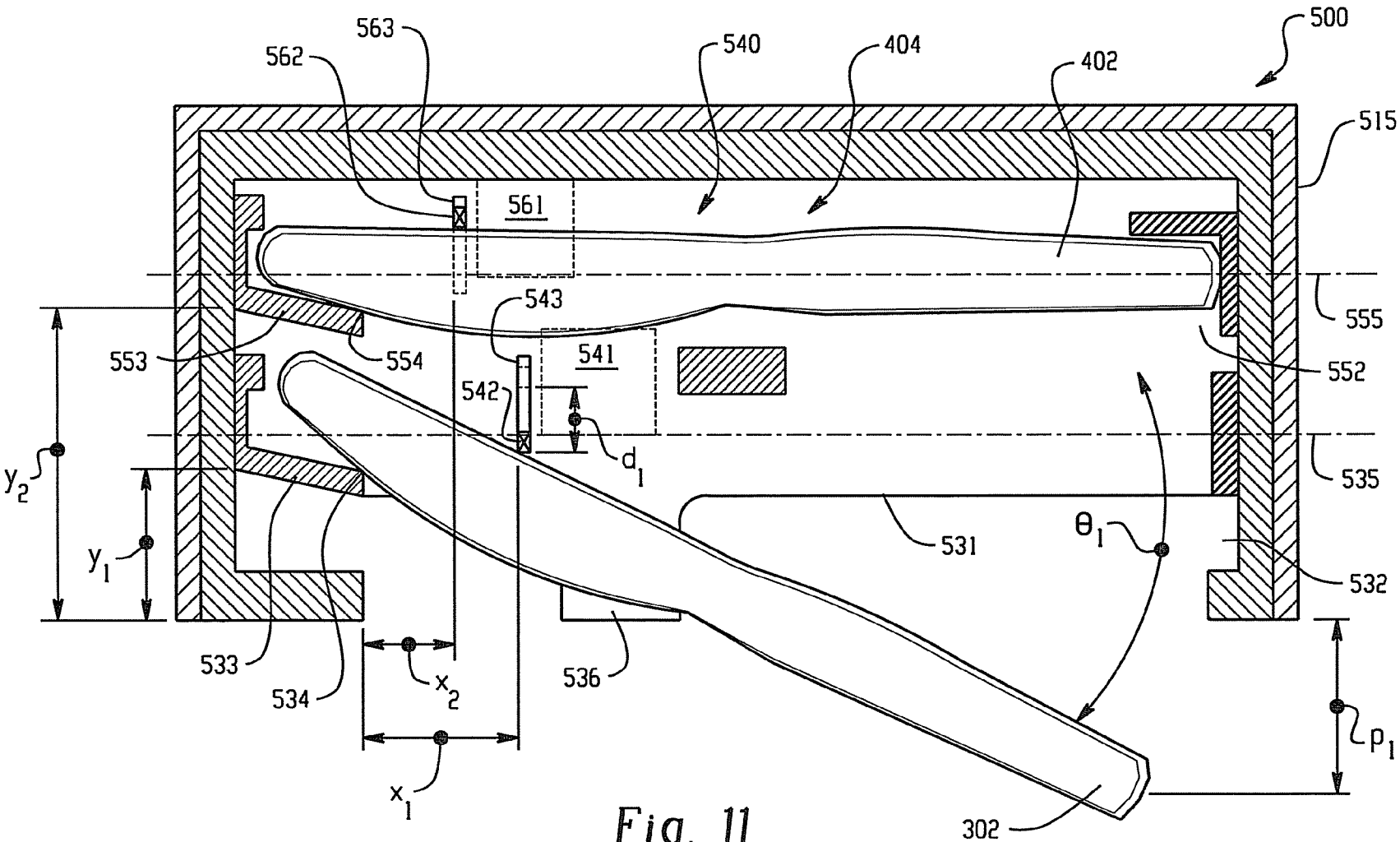
FIG. 11 is a schematic top cross sectional view of a multiple compartment cutlery utensil dispenser implementing an embodiment with a first cutlery utensil in the second orientation.
Figure 12:
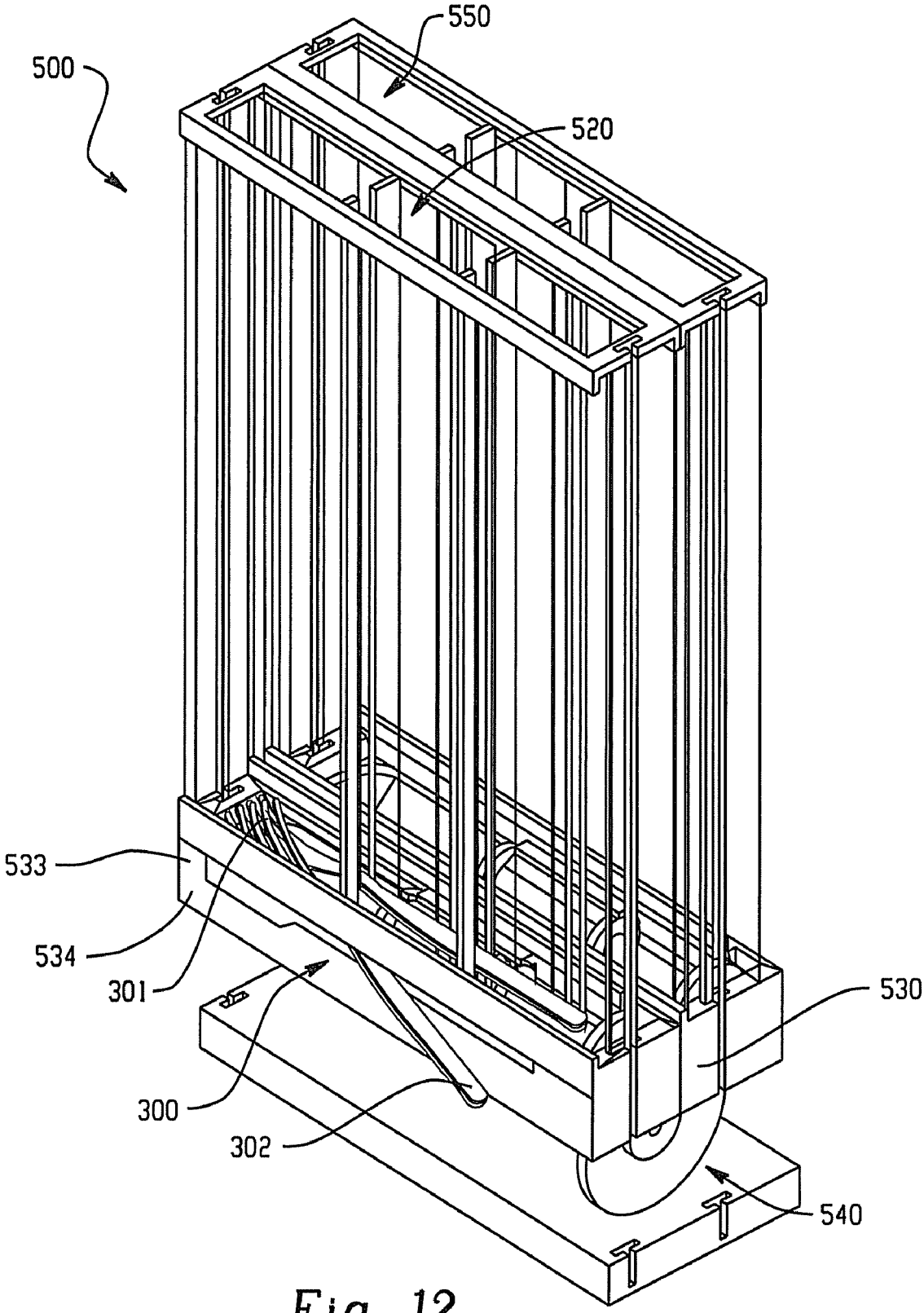
FIG. 12 is a schematic isometric view of a dispenser implementing an embodiment with multiple stacks of cutlery utensils with its housing removed and a first cutlery utensil in the second orientation.

To rotate the cutlery utensil 300, the dispensing mechanism 540 is provided that includes a first actuator 541 mounted, for example, beneath the floor 531 of the compartment, as represented by the dashed lines of the elements in FIGS. 10, 11, 13, and 14. The dispensing mechanism 540, responsive to a trigger 516, 517 as discussed above, uses the first actuator 541 to move a first engagement portion 542 into engagement with the first cutlery utensil 300. In the embodiment shown as an example, the first engagement portion 542 is moved along a first slot 543. The first slot 543 extends at least a distance $d_1$ transverse to the longitudinal axis 535 of the first region 532. As the first engagement portion 542 slides the portion of the first cutlery utensil 300 it engages, the first cutlery utensil 300 begins to rotate about the fulcrum end 534 of the first wall 533 of the first region out of the first orientation 304 shown in FIG. 10. In an embodiment, the first engagement portion 542 remains flush with or beneath the floor 531 until it is moved. The dispensing mechanism 540 moves the first engagement portion 542 so that, as seen in FIG. 10, the first cutlery utensil 300 rotates to the second orientation 305, with the second portion 302 of the cutlery utensil 300 remaining at the same angle relative to the floor 531. In the example embodiment in which the second portion 302 is substantially parallel to the floor 531 in the first orientation 304, the second portion 302 remains substantially parallel to the floor 531 during rotation and in the second orientation 305. A substantially flat second portion is also substantially parallel to the floor in a direction transverse to the longitudinal axis of the second portion in the first orientation of an embodiment. In an embodiment, a support tongue 536 supports the cutlery utensil 300 in the second orientation 305. As seen in FIGS. 11 and 12, the second portion 302 of the first cutlery utensil 300 projects from the dispensing tray 530, and from the exit 515 of the dispenser 500, from which the user can grasp the second portion 302 and remove the first cutlery utensil 300 from the dispenser 500.

In the course of rotation, as seen in FIGS. 9-12, the first cutlery utensil 300 sweeps through an angle $\theta_1$ that varies with a distance $x_1$ of the engagement portion 542 from the pivot point 303, such as the fulcrum end 534 of the first wall 533 of the first region, as well as a distance $y_1$ of the first pivot point 303 from the exit 515 of the dispenser 500. However, it is more practical to refer to the distance $Y_1$ representing the distance $y_1$ to the exit 515 plus the distance $p_1$ by which the first utensil extends from the housing 510. More specifically, the angle $\theta_1$ is larger for smaller distances $x_1$ and must be larger for larger distances $Y_1$ to enable the second portion 302 of the first cutlery utensil 300 to project through the exit 515 by the same amount $p_1$ for a given length L from the first pivot point 103 to the end of the second portion 302 of the first cutlery utensil 300. The angle $\theta_1$ is related to the distances and length by the formula $$\theta_1 \approx \sin^{-1}(Y_1/L) \approx \tan^{-1}(d_1/x_1),$$

Thus, for a given length L, distance $Y_1$, and displacement $d_1$ of the engagement portion 542, the approximate required position of the first engagement portion can be found using:

$$x_1 \approx (d_1/\tan(\sin^{-1}(Y_1/L_1)))$$

Figure 13:
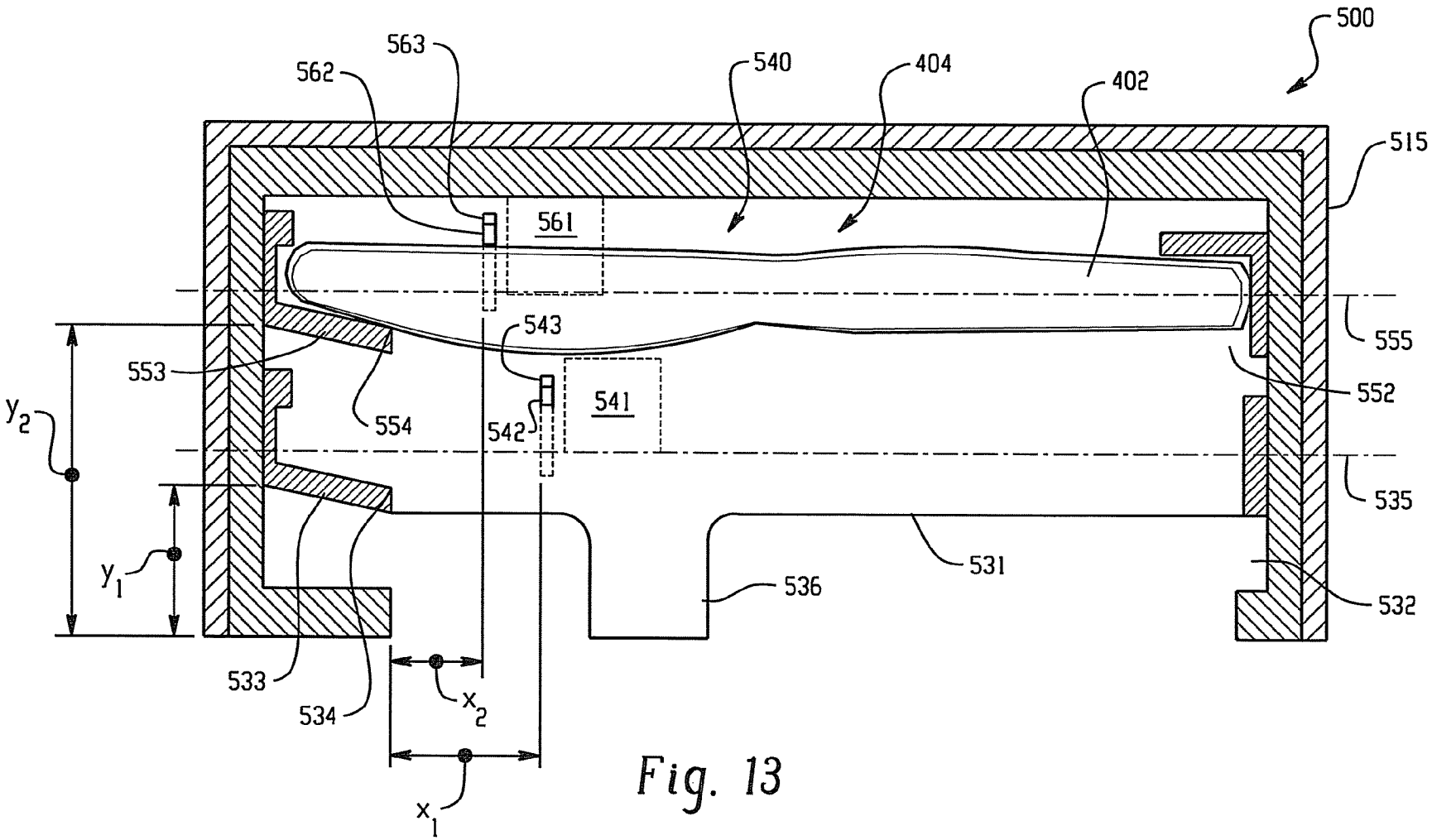
FIG. 13 is a schematic top cross sectional view of a multiple compartment cutlery utensil dispenser implementing an embodiment with a second cutlery utensil in the first orientation.
Figure 14:
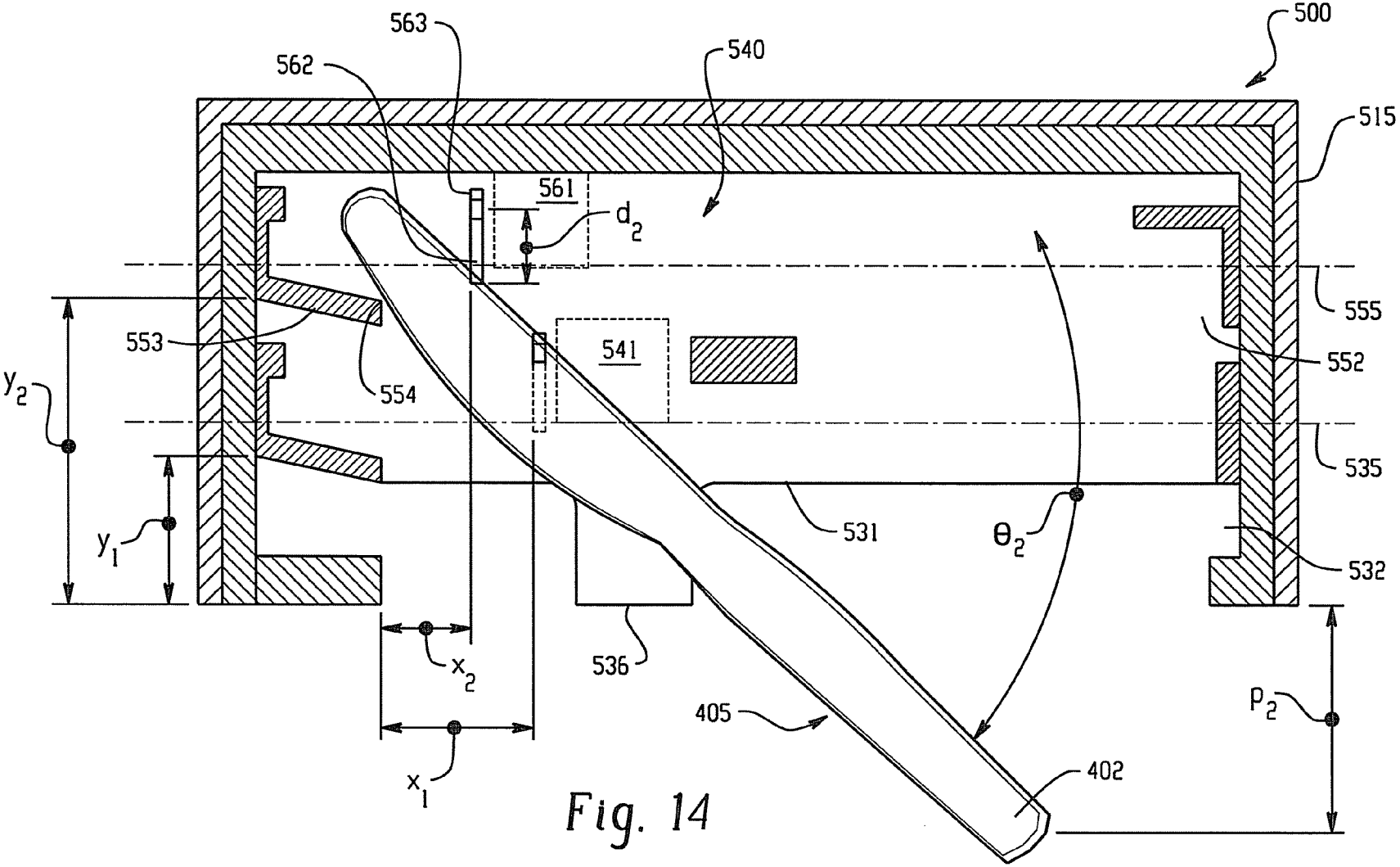
FIG. 14 is a schematic top cross sectional view of a multiple compartment cutlery utensil dispenser implementing an embodiment with a second cutlery utensil in a third orientation.
Figure 15:
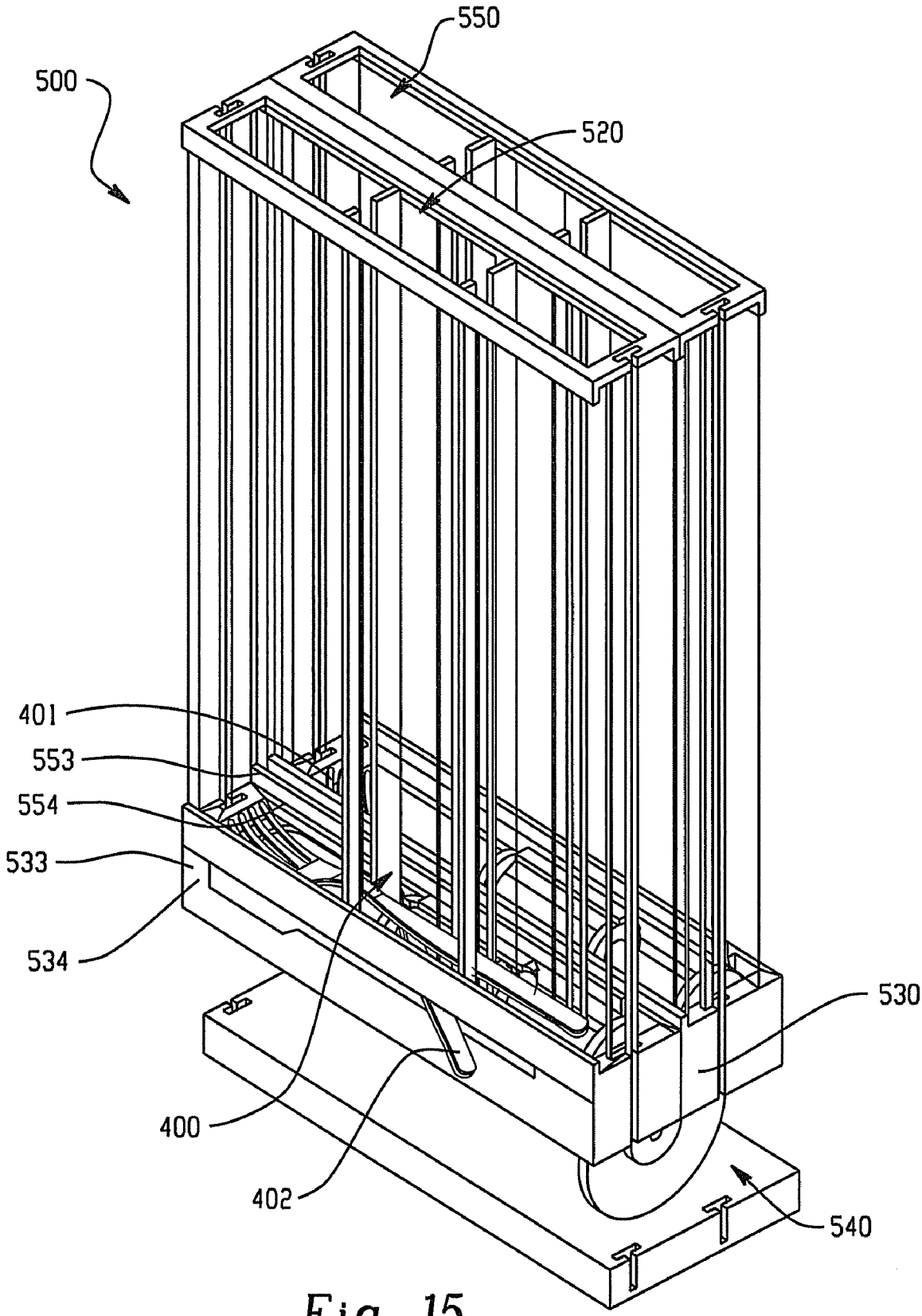
FIG. 15 is a schematic isometric view of a dispenser implementing an embodiment with multiple stacks of cutlery utensils with its housing removed and a second cutlery utensil in the third orientation.

As seen variously in FIGS. 12-15, the dispensing tray 530 includes a second region 552 dimensioned to retain the second cutlery utensil 400. The second cutlery utensil 400 is also the bottom cutlery utensil of a second stack of cutlery utensils retained in the compartment 550. The second cutlery utensil 400, having first and second portions 401, 402, is in part retained by a first wall 553 of the second region, such as a partial wall. The pivot point 403 in an embodiment is a fulcrum end 554 of the first wall 553 of the second region 552, but can be a pin or other suitable formation or element. In the first orientation 404, a longitudinal axis of the second portion 402 of the cutlery utensil 400 is at an angle relative to the floor 531. The longitudinal axis is the same in this example as in the cutlery utensil 100 of FIG. 2. For example, in an embodiment the second portion 402 rests with its longitudinal axis at an angle of substantially zero degrees relative to the floor 531 so that the longitudinal axis is substantially parallel to the floor 531 in the first orientation 404. To rotate the second cutlery utensil 400, the dispensing mechanism 540 in an embodiment includes a second actuator 561 mounted, for example, beneath the floor 531 of the compartment, as represented by the dashed lines in FIGS. 10, 11, 13, and 14. The dispensing mechanism 540, responsive to a trigger 516, 517 as discussed above, uses the second actuator 561 to move a second engagement portion 562 into engagement with the second cutlery utensil 400. In the embodiment shown as an example, the second engagement portion 562 is moved along a second slot 563 that extends at least a distance $d_2$ transverse to the longitudinal axis 555 of the first region 552. As the second engagement portion 562 slides the portion of the second cutlery utensil 400 it engages, the second cutlery utensil 400 begins to rotate about the fulcrum end 554 of the first wall 553 of the second region out of the first orientation 404 shown in FIG. 13 with the second portion 402 of the cutlery utensil 400 remaining at the same angle relative to the floor 531. In the example embodiment in which the second portion 402 is substantially parallel to the floor 531 in the first orientation 404, the second portion 402 remains substantially parallel to the floor 531 during rotation and in the second orientation 405 shown in FIG. 14. A substantially flat second portion is also substantially parallel to the floor in a direction transverse to the longitudinal axis of the second portion in the first orientation of an embodiment. In an embodiment, the second engagement portion 562 remains flush with or beneath the floor 531 until it is moved. The dispensing mechanism 540 moves the second engagement portion 562 so that, as seen in FIG. 13, the second cutlery utensil 400 rotates to a third orientation 305. In an embodiment, a support tongue 536 is included to support the cutlery utensils 300, 400 in the second and third orientations 305, 405. With particular reference to FIGS. 14 and 15, the second portion 402 of the second cutlery utensil 400 projects from the dispensing tray 530, and from the exit 515 of the dispenser 500, from which the user can grasp the second portion 402 and remove the second cutlery utensil 400 from the dispenser 500.

In the course of rotation, as seen variously in FIGS. 12-15, the second cutlery utensil 400 sweeps through an angle $\theta_2$ that varies with a distance $x_2$ of the second engagement portion 562 from the second pivot point 403, such as the fulcrum end 554 of the first wall 553 of the second region, as well as a distance $y_2$ of the second pivot point 403 from the exit 515 of the dispenser 500. However, it is more practical to refer to the distance $Y_2$ representing the distance $y_2$ to the exit 515 plus the distance $p_2$ by which the utensil extends from the housing 510. More specifically, the angle $\theta_2$ is larger for smaller distances $x_1$ and must be larger for larger distances $Y_2$ to enable the second portion 402 of the second cutlery utensil 400 to project through the exit 515 by the same amount $p_2$ for a given length L from the second pivot point 403 to the end of the second portion 402 of the second cutlery utensil 400. The angle $\theta_2$ is related to the distances and length by the formula $$\theta_2 \approx \sin^{-1}(Y_2/L) \approx \tan^{-1}(d_2/x_2),$$

Thus, for a given length L, distance Y, and displacement d of the second engagement portion 562, the approximate position of the second engagement portion required can be found using:

$$x_2 \approx (d_2/\tan(\sin^{-1}(Y_2/L)))$$

Figure 16:
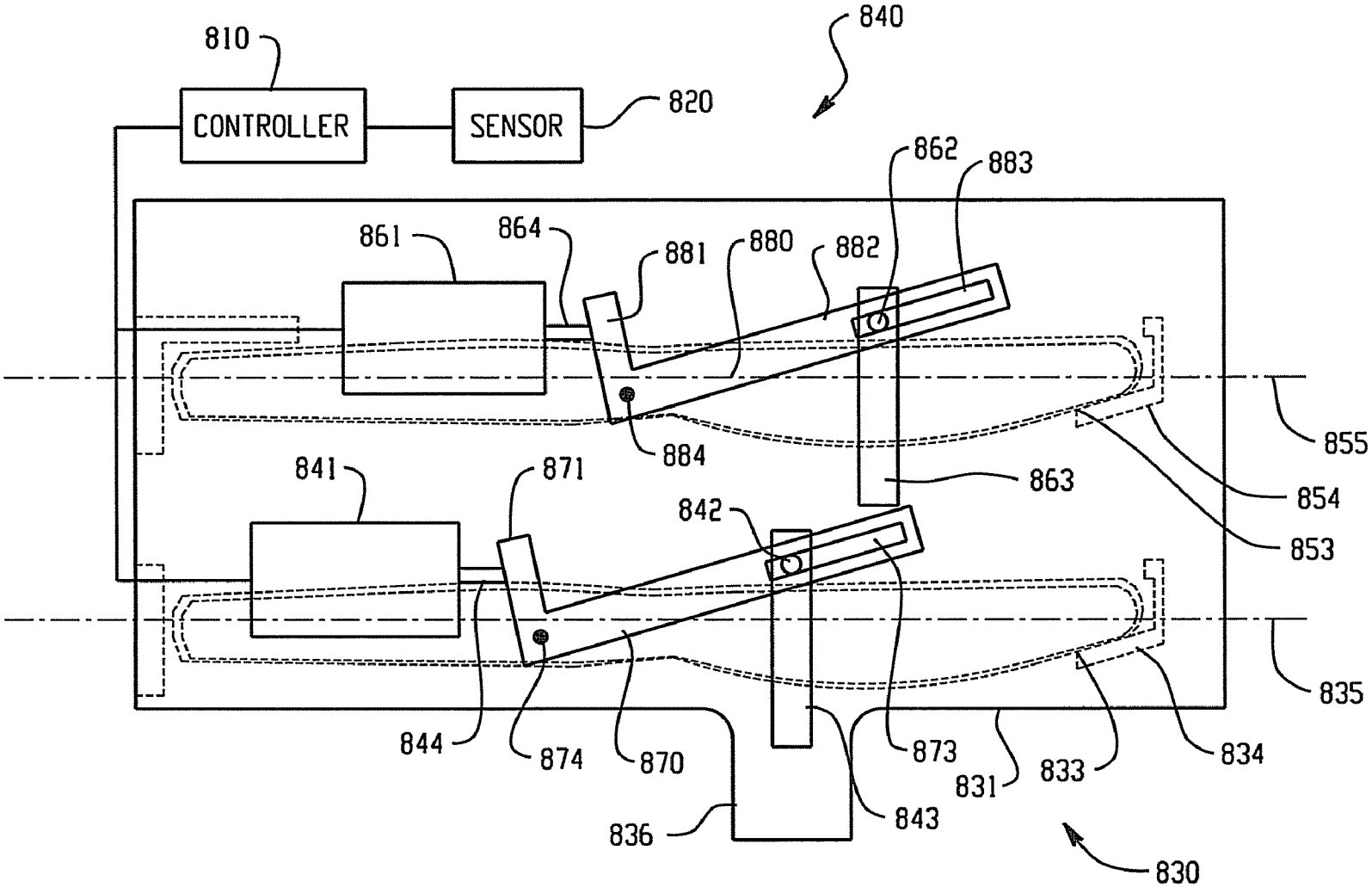
FIG. 16 is a schematic bottom elevational view of a dispensing tray implementing an embodiment with multiple stacks of cutlery utensils with all cutlery utensils in the first orientation.
Figure 17:
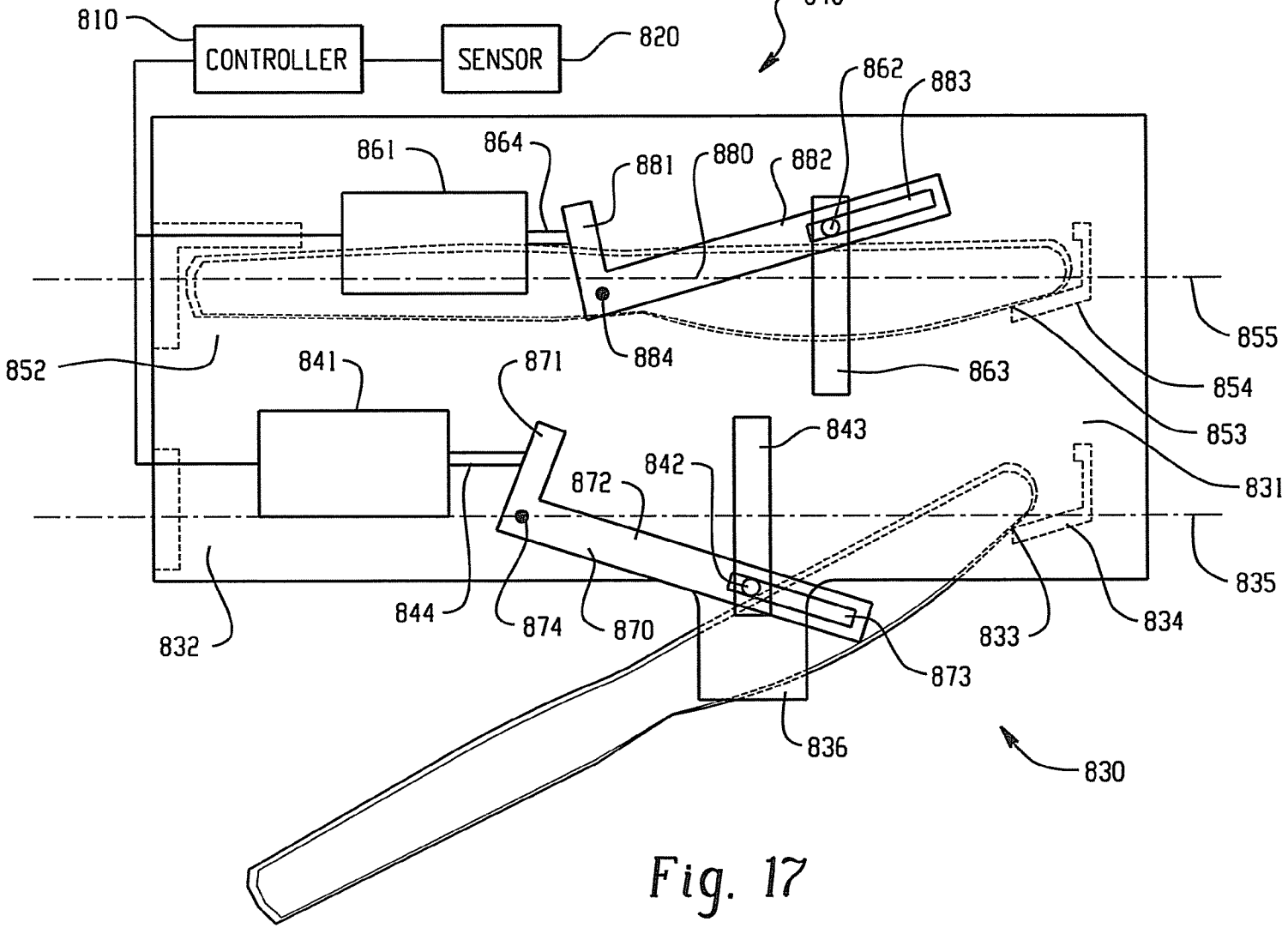
FIG. 17 is a schematic bottom elevational view of a multiple compartment cutlery utensil dispenser implementing an embodiment with a first cutlery utensil in the second orientation.
Figure 18:
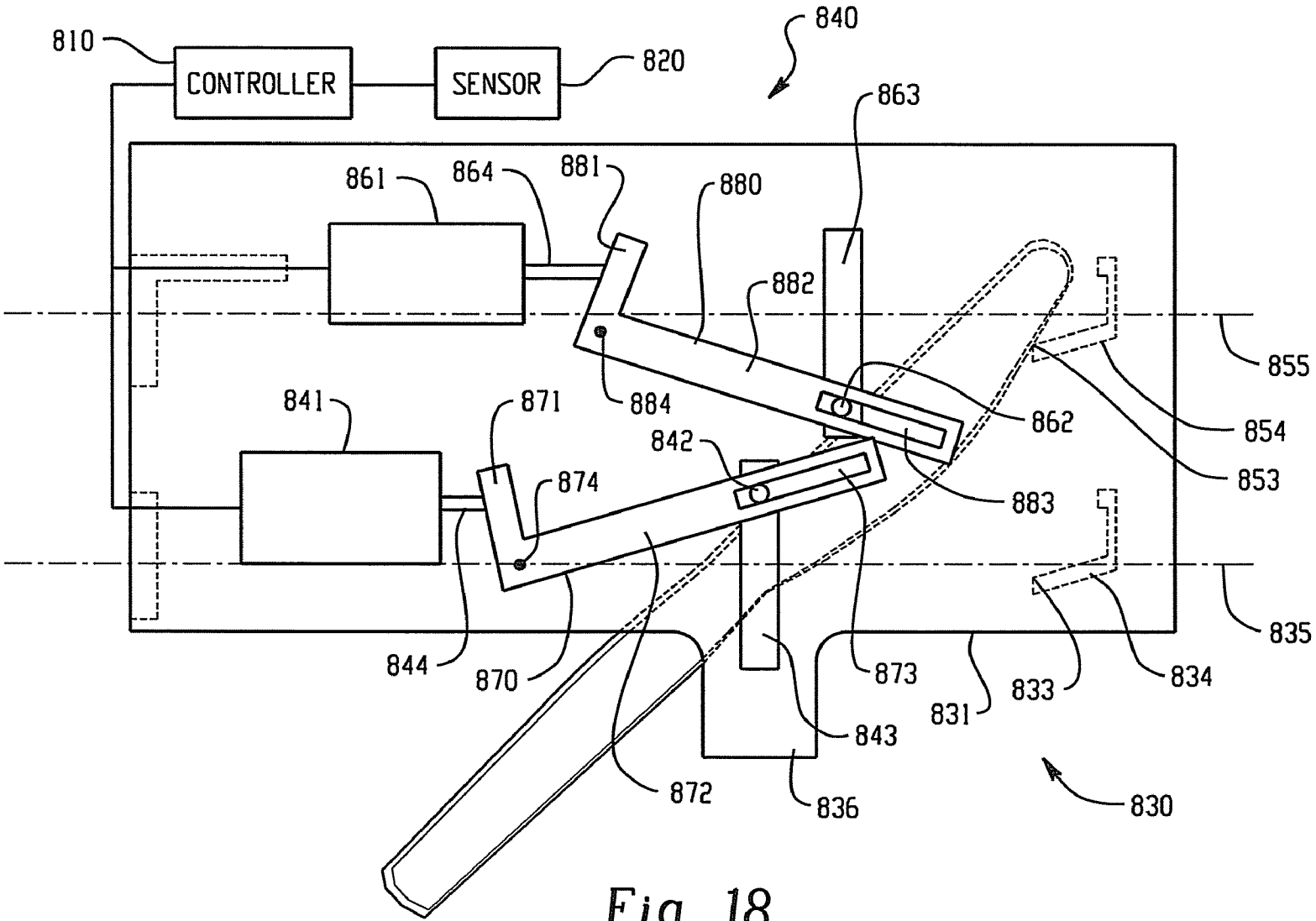
FIG. 18 is a schematic bottom elevational view of a multiple compartment cutlery utensil dispenser implementing an embodiment with a second cutlery utensil in a third orientation.

An embodiment of a dispensing mechanism 840 is shown in FIGS. 16-18, which shows a multiple-cutlery-utensil dispensing tray 830 from below. The dispensing mechanism 840 includes a controller 810 and a trigger 820, such as a sensor, a button, or a switch. The controller 810 is connected to a first solenoid 841 mounted beneath the floor 831 of a dispensing tray 830 that includes a tongue 836 to support dispensed cutlery utensils. The first solenoid 841 causes the first engagement portion 842 to move, such as by sliding in a first slot 843 via a substantially L-shaped first lever 870, first and second ends 871, 872 of the lever defining the legs of the L-shape of the first lever 870. The first solenoid 841 includes a first solenoid plunger 844 that engages the first end 871 of the first lever 870, as seen in FIG. 16, and the second end 872 of the first lever 870 engages the first engagement portion 842. The first lever 870 in embodiments includes a slot 873 in its second end 872 that acts a lost motion connection in which the first engagement portion 842 is retained. Responsive to the controller 810, the first solenoid plunger 844 extends, pushing the first end of the first lever 870 so that it and the second end 872 of the first lever rotate about a first lever pivot 874, sliding the first engagement portion 842 along the first slot 843.

The embodiment of a dispensing mechanism 800 shown in FIGS. 16-18 also includes a second solenoid 861 connected to the controller 810 and mounted beneath the floor 831 of the dispensing tray 830. The second solenoid 861 causes the second engagement portion 862 to move, such as by sliding in a second slot 863 via a substantially L-shaped second lever 880, first and second ends 881, 882 of the lever defining the legs of the L-shape of the second lever 880. The second solenoid 861 includes a second solenoid plunger 864 that engages the first end 881 of the second lever 880, as seen in FIG. 16, and the second end 882 of the second lever 880 engages the second engagement portion 862. The second lever 880 in embodiments includes a slot 883 in its second end 882 that acts a lost motion connection in which the second engagement portion 862 is retained. Responsive to the controller 810, the second solenoid plunger 864 extends, pushing the first end of the second lever 880 so that it and the second end 882 of the second lever rotate about a second lever pivot 884, sliding the second engagement portion 862 along the second slot 863. As seen variously in the example embodiment of FIGS. 16-18, the solenoid plungers 844, 864 extend and move parallel to the longitudinal axes 835, 855 of the first and second compartments 832, 852.

While one solenoid is shown for each cutlery utensil region in the dispensing mechanism 840, it is within the scope of embodiments to employ a single solenoid with a different mechanical arrangement to dispense cutlery utensils from all cutlery utensil regions. It is also within the scope of embodiments to employ other electrical driving devices, such as electric motors, to dispense the cutlery utensils. Further, the mechanical portions of the dispensing mechanism 840 can be driven by manual means, such as a handle or a lever, though such manual means presents an opportunity for cross-contamination between users. While levers have been shown as motion conversion devices, embodiments can employ other motion conversion devices, such as gearing, screw drives, and ball drives, or even simple direct connections.

A preferred trigger 820 in embodiments is a sensor such as an infrared sensor of the type commonly used on automatic faucets, soap dispensers, and paper towel dispensers. In such sensor arrangements, for example, a reference beam of infrared radiation is emitted and an infrared radiation detector is arranged such that reflected IR radiation, such as from a nearby hand, strikes the IR detector, closing a circuit and/or sending a signal to the controller. In embodiments, a second sensor can be employed to detect the presence of a cutlery utensil in the exit of the dispenser. Thus, should a user try to dispense a cutlery utensil when one is already in the exit, the controller blocks activation of the actuator(s). In another embodiment, a cutlery utensil is dispensed at power up and one sensor is used to monitor the exit for removal of the cutlery utensil so that a next-to-be-dispensed cutlery utensil is dispensed to replace the removed cutlery utensil.

Figure 19:
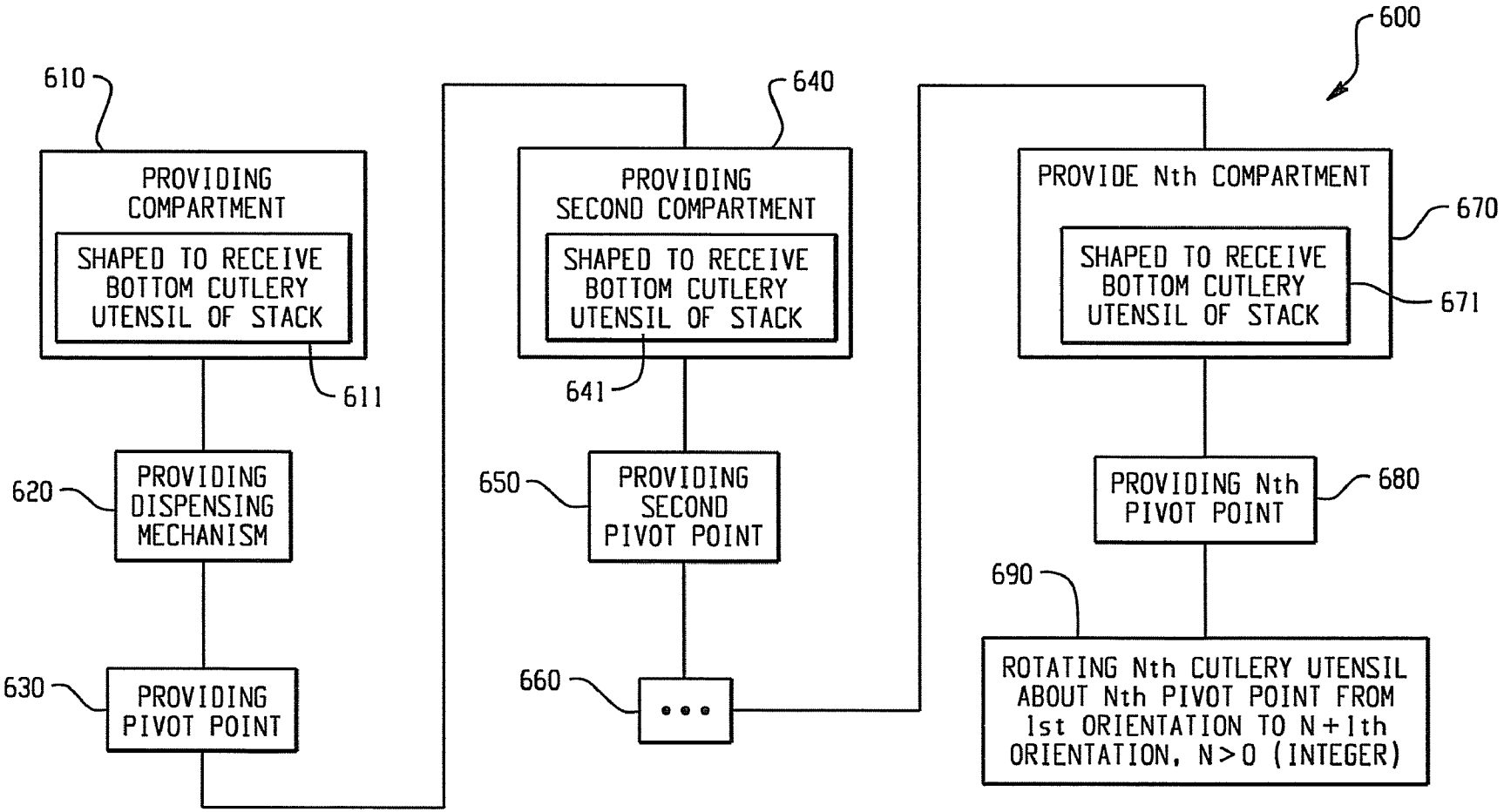
FIG. 19 is a schematic flow diagram of a method according to an embodiment.

As seen in FIG. 19, a method 600 according to an embodiment therefore comprises providing a compartment with a floor and a wall shaped to receive a cutlery utensil (block 610), such as the compartment 232, floor 231, and wall 233 shown in FIGS. 4-7 and 9-18. The method continues by providing a dispensing mechanism (block 620) and providing a pivot point (block 630), such as a fulcrum end 234 of the wall 233 of the compartment 232 shown in FIGS. 4-7 and 9-18, about which the cutlery utensil 100 rotates responsive to movement of the dispensing mechanism 240. The cutlery utensil 100 rotates from the first orientation 104 in which the cutlery utensil 100 is inaccessible to a user to the second orientation 105 in which the second portion 102 of the cutlery utensil 100 is accessible to the user, such as by projecting from the exit 215 of a dispenser 200. In an embodiment, the compartment is shaped to receive a bottom one of a respective stack of cutlery utensils (block 611).

The method 600 in an embodiment further includes providing a second compartment including a floor and a wall shaped to receive a second cutlery utensil (block 640), the second cutlery utensil having first and second portions. In such an embodiment, the method also includes providing a second pivot point (block 650) and rotating the second cutlery utensil from a first orientation parallel to the first orientation of the first cutlery utensil to a third orientation in which the second portion of the second cutlery utensil is accessible to a user. In an embodiment, the first orientation of the second cutlery utensil is substantially identical and parallel to, but spaced apart from the first orientation of the first cutlery utensil. The third orientation is similar to the second orientation, but the second cutlery utensil sweeps through a larger angle $\theta_2$ to enable accessibility of the second portion of the second cutlery utensil. In an embodiment, the second compartment is shaped to receive a bottom one of a respective stack of cutlery utensils (block 641).

As seen again with reference to FIG. 19, providing a compartment in an embodiment of the method 600 includes providing a plurality of N compartments shaped to receive respective cutlery utensils, each cutlery utensil having respective first and second portions. In such an embodiment, providing a pivot point comprises providing a plurality of N pivot points corresponding to respective ones of the N compartments. Providing a plurality of N compartments and providing a plurality of N pivot points is represented by the method 600 overall, with the gap between the second compartment and pivot point and the Nth compartment and pivot point represented by block 660. In other words, the method in an embodiment includes providing an Nth compartment (block 670) and providing an Nth pivot point (block 680). Responsive to movement of the dispensing mechanism, an Nth cutlery utensil rotates from a respective first orientation in which the Nth cutlery utensil is inaccessible to a user to a respective one of N+1 orientations in which the respective second portion is accessible to a user. The second portion of each cutlery utensil will sweep through an angle $\theta_N$ that varies with a distance $x_N$ of the Nth engagement portion from the Nth pivot point, as well as a distance $y_N$ of the Nth pivot point from the exit of the dispenser. N in such an embodiment is an integer. For example, in the embodiment shown in FIGS. 8-18, N is 2 so that there are 2 compartments receiving first and second utensils and 2 pivot points corresponding to respective ones of the 2 compartments.

In an embodiment, each compartment is shaped to receive a bottom cutlery utensil of a respective stack of substantially identical cutlery utensils such that a next cutlery utensil replaces the bottom cutlery utensil when the bottom cutlery utensil is dispensed. In other words, the Nth compartment is shaped to receive a bottom cutlery utensil of a stack of cutlery utensils (block 671). Each of the plurality of N stacks in an embodiment has a respective engagement portion such that, responsive to movement of the Nth engagement portion, the Nth cutlery utensil is dispensed. Additionally, in an embodiment, providing a dispensing mechanism further comprises providing each of the plurality of N stacks with a respective actuator connected to the respective engagement portions such that, responsive to activation of the Nth actuator, the Nth engagement portion is moved and the Nth cutlery utensil is dispensed.

While the example embodiments in the FIGS. are shown as having all compartments shaped to receive the same type of utensil, other embodiments can have compartments shaped to receive mixed types of cutlery utensil. In other words, in an embodiment, a first number of compartments are shaped to receive a first type of cutlery utensil, a second number of compartments are shaped to receive a second type of cutlery utensil, and additional numbers of compartments can be included to receive additional types of cutlery utensils. Thus, one or more compartments might be shaped to receive knives, while one or more other compartments might be shaped to receive forks, and one or more additional compartments might be shaped to receive spoons, or other combinations of compartments can be used.

The flow diagrams depicted herein are just one example. There may be many variations to the diagrams or the steps (or operations) described therein without departing from the spirit of the invention. For instance, the steps may be performed in a differing order or steps may be added, deleted or modified. All of these variations are considered a part of the claimed invention.

Aspects of the invention can be implemented with computer processor hardware and computer software and/or computer program products arranged to store, read, and execute computer code, such as object code, source code, or executable code. Thus, an embodiment of the invention includes computer-implemented processes or methods and apparatus for practicing such processes, such as the controller, which can include a computer processor. Embodiments that include a computer software application or program product that includes computer code, such as object code, source code, or executable code, have the computer software application or program product on a storage device that includes tangible, computer readable media, such as magnetic media (floppy diskettes, hard disc drives, tape, etc.), optical media (compact discs, digital versatile/video discs, magneto-optical discs, etc.), random access memory (RAM), read only memory (ROM), flash ROM, erasable programmable read only memory (EPROM), electrically erasable programmable read only memory (EEPROM), or any other computer readable storage medium on which the computer program code is stored and with which the computer program code can be loaded into and executed by a computer. When the computer executes the computer program code, it becomes an apparatus for practicing the invention, and on a general purpose microprocessor, specific logic circuits are created by configuration of the microprocessor with computer code segments. For example, the method as described above when implemented as computer software and executed on a processor creates respective means for performing the steps of the method. A technical effect of the executable instructions is to dispense cutlery utensils responsive to a trigger, such as a button, switch, or sensor, and/or to prevent dispensing of cutlery utensils when a cutlery utensil is present in an exit of the dispenser.

The computer program code is written in computer instructions executable by the computer processor, such as in the form of software encoded in any programming language. Examples of suitable programming languages include, but are not limited to, assembly language, VHDL (Verilog Hardware Description Language), Very High Speed IC Hardware Description Language (VHSIC HDL), FORTRAN (Formula Translation), C, C++, C#, Java, ALGOL (Algorithmic Language), BASIC (Beginner All-Purpose Symbolic Instruction Code), APL (A Programming Language), ActiveX, HTML (HyperText Markup Language), XML (eXtensible Markup Language), and any combination or derivative of one or more of these.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

The invention claimed is:

1. A cutlery utensil dispenser for dispensing cutlery utensils and comprising:

a dispensing tray including a floor and a region dimensioned and configured to house a cutlery utensil having first and second portions in a first orientation in which the cutlery utensil rests on the floor in the region and in which the cutlery utensil is within the cutlery utensil dispenser and inaccessible to a user;

a wall of the region having a fulcrum end dimensioned to engage the cutlery utensil; and a dispensing mechanism including an engagement portion to selectively engage the cutlery utensil and to move an engaged portion of the cutlery utensil toward an exit of the dispenser such that the cutlery utensil rotates about the fulcrum end until the second portion of the cutlery utensil projects from the cutlery utensil dispenser and is accessible to the user in a second orientation, wherein the fulcrum end is dimensioned to engage the cutlery utensil in the region and distant from the exit.

2. The dispenser of claim 1 wherein the second portion is at an angle relative to the floor in the first orientation, and the fulcrum end of the wall engages the cutlery utensil so that, in response to motion of the engaged portion of the cutlery utensil induced by the engagement portion of the dispensing mechanism, the cutlery utensil rotates about the fulcrum end from the first orientation to the second orientation with the second portion of the cutlery utensil remaining at substantially the same angle relative to the floor.

3. The cutlery utensil dispenser of claim 1 wherein the fulcrum end is dimensioned to engage the cutlery utensil in the region at a distance y from the exit, the engagement portion selectively engages the cutlery utensil at a distance x from the fulcrum end of the wall and moves the engaged portion a distance d toward the exit, and the second portion projects a distance p from the exit such that:

$$\sin^{-1}(Y/L) \approx \tan^{-1}(d/x),$$

where Y=y+p and L is a length of the cutlery utensil from a point at which the fulcrum end engages the cutlery utensil to an end of the second portion.

4. The cutlery utensil dispenser of claim 1 wherein the floor of the dispensing tray includes a slot having a length of at least d extending transverse to a longitudinal axis of the region and the engagement portion selectively extends into the region through the slot.

5. A cutlery utensil dispenser for dispensing cutlery utensils and comprising:

a dispensing tray including a floor and a region dimensioned and configured to house a cutlery utensil having first and second portions in a first orientation in which the cutlery utensil rests on the floor in the region and in which the cutlery utensil is within the cutlery utensil dispenser and inaccessible to a user;

a wall of the region having a fulcrum end dimensioned to engage the cutlery utensil; and a dispensing mechanism including an engagement portion to selectively engage the cutlery utensil and to move an engaged portion of the cutlery utensil toward an exit of the dispenser such that the cutlery utensil rotates about the fulcrum end until the second portion of the cutlery utensil projects from the cutlery utensil dispenser and is accessible to the user in a second orientation, wherein the floor of the dispensing tray includes a slot having a length of at least d extending transverse to a longitudinal axis of the region and the engagement portion selectively extends into the region through the slot, wherein the dispensing mechanism comprises an electrical driving mechanism drivingly connected to the engagement portion, the electrical driving mechanism moving the engagement portion in the slot responsive to a command, thereby moving the engagement portion into engagement with and moving the cutlery utensil.

6. The cutlery utensil dispenser of claim 5 further comprising a switch electrically connected to the electrical driving mechanism so as to provide the command and activate the electrical driving mechanism when the switch changes from one of an open state and a closed state to the other of the open state and the closed state.

7. The cutlery utensil dispenser of claim 6 wherein the switch is responsive to an actuator mounted on the housing.

8. The cutlery utensil dispenser of claim 6 wherein the switch is responsive to a sensor.

9. The cutlery utensil dispenser of claim 5 wherein the electrical driving mechanism is a solenoid.

10. The cutlery utensil dispenser of claim 5 wherein the dispensing mechanism further comprises a substantially L shaped lever with a first end and a second end defining respective legs of the L-shape, the first end of the lever engaged and selectively driven by the electrical driving mechanism, the second end of the lever connected to and driving the engagement portion, the lever being pivotably connected to the floor at a junction of the first and second ends.

11. The cutlery utensil dispenser of claim 10 wherein the second end of the lever includes a slot extending along a longitudinal axis of the second end and the engagement portion is slidably retained in the slot so that, responsive to the electrical driving mechanism moving the first end of the lever, the second end of the lever pivots from a first position to a second position to push the engagement portion along the slot in the floor, the engagement portion sliding in the slot in the second end of the lever as the engagement portion slides in the slot in the floor.

12. The cutlery utensil dispenser of claim 11 wherein the dispensing mechanism further comprises a spring biasing the second end of the lever toward the first position.

13. The cutlery utensil dispenser of claim 5 further comprising a controller electrically connected to the electrical driving mechanism and to a sensor mounted on the housing to monitor a region proximate the exit.

14. The cutlery utensil dispenser of claim 13 wherein the sensor sends a signal to the controller board responsive to at least one of a presence of a cutlery utensil in the exit, motion in a field of view of the sensor, and proximity of an object in a field of view of the sensor.

15. The cutlery utensil dispenser of claim 13 wherein the controller board activates the electrical driving mechanism in response to a signal from the sensor, thereby dispensing a cutlery utensil.

16. The cutlery utensil dispenser of claim 1 wherein the region is a bottom of a compartment, the compartment being dimensioned to house a stack of substantially identical cutlery utensils within the housing.

17. A cutlery utensil dispenser comprising:

a housing including an exit;

a base supporting the housing;

a first utensil compartment within the housing, the first utensil compartment including a floor and a wall and being so dimensioned as to house a cutlery utensil in a first orientation in which a handling portion of the cutlery utensil is substantially parallel to the floor along a longitudinal axis of the cutlery utensil, and in which the cutlery utensil is inaccessible to a user within the first utensil compartment;

a dispensing mechanism, the dispensing mechanism including a first engagement portion extending into the first utensil compartment;

a fulcrum formed in the compartment and establishing, at a distance $y_1$ from an exterior of the exit, a pivot axis substantially transverse to a floor of the compartment and about which the cutlery utensil rotates with the handling portion remaining substantially parallel to the floor, responsive to movement of the cutlery utensil induced by movement of the engagement portion, from the first orientation to a second orientation in which a utility portion of the cutlery utensil remains in the housing inaccessible to the user while the handling portion of the cutlery utensil is accessible to the user.

18. The dispenser of claim 17 further comprising a second compartment within the housing adjacent the first compartment, the second compartment being shaped to receive a second cutlery utensil in the first orientation in which a handling portion of the second cutlery utensil is substantially parallel to the floor along a longitudinal axis of the second cutlery utensil, and a second fulcrum formed in the second compartment and establishing, at a distance $y_2$ from an exterior of the exit, a second pivot axis substantially transverse to a floor of the second compartment and about which, responsive to movement of the second cutlery utensil induced by movement of the engagement portion, the second cutlery utensil rotates with its handling portion remaining substantially parallel to the floor from a first orientation substantially identical to the first orientation of the first cutlery utensil into a third orientation in which a utility portion of the second cutlery utensil remains in the housing inaccessible to the user while the handling portion of the second cutlery utensil is accessible to a user.

19. The dispenser of claim 17 wherein a bottom of the compartment is shaped to receive a bottom cutlery utensil of a stack of substantially identical cutlery utensils such that a next cutlery utensil replaces the bottom cutlery utensil when the bottom cutlery utensil is dispensed and removed from the dispenser.

20. The dispenser of claim 17 further comprising a plurality of N compartments, a bottom of each compartment being shaped to receive a respective cutlery utensil in a respective first orientation in which the respective cutlery utensil is inaccessible to the user within the cutlery utensil dispenser and in which a handling portion of the respective cutlery utensil is substantially parallel to a floor of the respective compartment along a longitudinal axis of the respective cutlery utensil, each cutlery utensil having respective utility and handling portions, each of the plurality of N compartments having a respective pivot point about which the respective cutlery utensil rotates with its handling portion remaining substantially parallel to the floor, responsive to movement of the respective cutlery utensil induced by movement of the engagement portion, from the respective first orientation to a respective one of N+1 orientations in which the respective handling portion is accessible to a user while the respective utility portion remains inaccessible to the user.

21. The dispenser of claim 20 wherein the bottom of each compartment is shaped to receive a bottom cutlery utensil of a respective stack of substantially identical cutlery utensils such that a next cutlery utensil replaces the bottom cutlery utensil in the respective first orientation when the bottom cutlery utensil is dispensed.

22. The dispenser of claim 17 wherein the dispensing mechanism further comprises a manually driven actuator mechanically connected to the engagement portion that selectively moves the engagement portion.

23. The dispenser of claim 20 wherein the dispensing mechanism further comprises a respective engagement portion for each of the plurality of N stacks such that, responsive to movement of a respective engagement portion, a respective cutlery utensil is dispensed.

24. The dispenser of claim 23 wherein the dispensing mechanism further comprises a respective actuator connected to the respective engagement portions of the plurality of N compartments such that, responsive to activation of an actuator, a respective engagement portion engages and moves a respective cutlery utensil.

25. The dispenser of claim 20 wherein all of the plurality of N compartments are shaped to receive substantially identical cutlery utensils in the respective first orientations.

26. The dispenser of claim 20 wherein a first number of compartments are shaped to receive a first type of cutlery utensil and a second number of compartments are shaped to receive a second type of cutlery utensil.

27. A cutlery utensil dispenser comprising:

a housing;

a compartment having a floor and a wall disposed within the housing and having a shape that receives a cutlery utensil in a first orientation in which the cutlery utensil is inaccessible to an end user and in which a substantially planar handling portion of the cutlery utensil is substantially parallel to the floor;

the housing comprising an exit sized to accommodate the handling portion of the cutlery utensil;

a dispensing mechanism disposed within the housing and in mechanical interaction with the cutlery utensil; and the housing comprising a pivot point within the compartment and distant from the exit of the housing, the pivot point being engageable with a dispensed one of the cutlery utensil and about which the dispensed cutlery utensil, responsive to the dispensing mechanism, rotates with the handling portion remaining substantially parallel to the floor from the first orientation into a second orientation in which the handling portion protrudes from the exit in the housing and is accessible to the end user while a utility portion of the cutlery utensil remains within the housing and inaccessible to the end user.

28. The dispenser of claim 27 wherein the dispensing mechanism further comprises a manually driven actuator mechanically connected to and that selectively moves an engagement portion.

29. A cutlery utensil dispenser comprising:

a housing;

a compartment having a floor and a wall disposed within the housing and having a shape that receives a cutlery utensil in a first orientation in which the cutlery utensil is inaccessible to an end user and in which a substantially planar handling portion of the cutlery utensil is substantially parallel to the floor;

the housing comprising an exit sized to accommodate the handling portion of the cutlery utensil;

a dispensing mechanism disposed within the housing and in mechanical interaction with the cutlery utensil; and the housing comprising a pivot point engageable with a dispensed one of the cutlery utensil and about which the dispensed cutlery utensil, responsive to the dispensing mechanism, rotates with the handling portion remaining substantially parallel to the floor from the first orientation into a second orientation in which the handling portion protrudes from the exit in the housing and is accessible to the end user while a utility portion of the cutlery utensil remains within the housing and inaccessible to the end user, the dispenser further comprising:

a plurality of N compartments in the housing each shaped to receive respective cutlery utensils in the first orientation, each cutlery utensil having a respective handling portion, and a pivot point in the housing corresponding to each of the plurality of N compartments and about which a respective cutlery utensil rotates, responsive to the dispensing mechanism and while the respective handling portion remains substantially parallel to the floor, from the respective first orientation in which the respective cutlery utensil is inaccessible to a user into a respective one of N+1 orientations in which the respective handling portion is accessible to a user while the respective utility portion remains within the housing and inaccessible to the user.

30. The dispenser of claim 29 wherein a bottom of each compartment is shaped to receive a bottom cutlery utensil of a respective stack of substantially identical cutlery utensils such that a next cutlery utensil replaces the bottom cutlery utensil when the bottom cutlery utensil is dispensed.

31. The dispenser of claim 29 wherein the dispensing mechanism further comprises a respective engagement portion for each of the plurality of N stacks such that, responsive to movement of a respective engagement portion, the respective engagement portion engages and moves the respective cutlery utensil.

32. The dispenser of claim 31 wherein the dispensing mechanism further comprises a respective actuator connected to the respective engagement portions of each of the plurality of N stacks such that, responsive to activation of a respective actuator, a respective engagement portion engages and moves a respective cutlery utensil.

33. A cutlery utensil dispenser comprising:

a housing;

a compartment having a floor and a wall disposed within the housing and having a shape that receives a cutlery utensil in a first orientation in which the cutlery utensil is inaccessible to an end user and in which a substantially planar handling portion of the cutlery utensil is substantially parallel to the floor;

the housing comprising an exit sized to accommodate the handling portion of the cutlery utensil;

a dispensing mechanism disposed within the housing and in mechanical interaction with the cutlery utensil; and the housing comprising a pivot point engageable with a dispensed one of the cutlery utensil and about which the dispensed cutlery utensil, responsive to the dispensing mechanism, rotates with the handling portion remaining substantially parallel to the floor from the first orientation into a second orientation in which the handling portion protrudes from the exit in the housing and is accessible to the end user while a utility portion of the cutlery utensil remains within the housing and inaccessible to the end user, wherein the dispensing mechanism further comprises a controller connected to an electrical actuator that is mechanically connected to the engagement portion, the controller being connected and responsive to a sensor such that the controller activates the electrical actuator to dispense a cutlery utensil when the sensor sends a signal.

* * * * *